US011813870B2

(12) United States Patent
Ogawa

(10) Patent No.: US 11,813,870 B2
(45) Date of Patent: Nov. 14, 2023

(54) LIQUID DISCHARGE APPARATUS

(71) Applicant: BROTHER KOGYO KABUSHIKI KAISHA, Nagoya (JP)

(72) Inventor: Mikio Ogawa, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 144 days.

(21) Appl. No.: 17/383,414

(22) Filed: Jul. 22, 2021

(65) Prior Publication Data

US 2021/0347175 A1 Nov. 11, 2021

Related U.S. Application Data

(63) Continuation of application No. PCT/JP2020/001848, filed on Jan. 21, 2020.

(30) Foreign Application Priority Data

Jan. 24, 2019 (JP) ..... 2019-010590

(51) Int. Cl.
*B41J 2/165* (2006.01)

(52) U.S. Cl.
CPC ..... *B41J 2/16538* (2013.01); *B41J 2/16535* (2013.01); *B41J 2/16541* (2013.01); *B41J 2/16544* (2013.01)

(58) Field of Classification Search
CPC ..... B41J 2/16538; B41J 2/16535; B41J 2/16541; B41J 2/16544; B41J 2/16508; B41J 2/16588
See application file for complete search history.

(56) References Cited

U.S. PATENT DOCUMENTS 6,340,219 B1 * 1/2002 Kumagai ..... B41J 2/16547 15/247
2001/0055043 A1 12/2001 Wanibuchi et al.
(Continued)

FOREIGN PATENT DOCUMENTS

EP 3398783 A1 11/2018
JP H10-166603 A 6/1998
(Continued)

OTHER PUBLICATIONS

International Preliminary Report on Patentability for PCT/JP2020/001848 dated Jul. 24, 2021.
(Continued)

*Primary Examiner* — Geoffrey S Mruk
(74) *Attorney, Agent, or Firm* — KENEALY VAIDYA LLP

(57) ABSTRACT

There is provided a liquid discharge apparatus including: a head including a nozzle surface; a wiper including a blade and a blade holder; a posture changer configured to change a posture of the blade to a first posture in which the blade makes contact with the nozzle surface and to a second posture which is different from the first posture; and a cleaner including a cleaning surface intersecting the nozzle surface. The blade in the first posture is configured to move in a first sliding direction relatively with respect to the head in a state in which the blade makes contact with the nozzle surface. The blade in the second posture is configured to move in a second sliding direction intersecting the first sliding direction relatively with respect to the cleaner in a state in which the blade makes contact with the cleaning surface.

11 Claims, 17 Drawing Sheets

(56) References Cited

U.S. PATENT DOCUMENTS

| | | | |
|---|---|---|---|
| 2002/0105560 | A1 | 8/2002 | Shimizu et al. |
| 2012/0299996 | A1 | 11/2012 | Kano et al. |
| 2016/0114585 | A1 | 4/2016 | Kobayashi |
| 2016/0288508 | A1 | 10/2016 | Kuno |
| 2018/0126737 | A1 | 5/2018 | Asano |

FOREIGN PATENT DOCUMENTS

| | | | |
|---|---|---|---|
| JP | 2002-001977 | A | 1/2002 |
| JP | 2002-321376 | A | 11/2002 |
| JP | 2004-202837 | A | 7/2004 |
| JP | 2007-118344 | A | 5/2007 |
| JP | 2009-132007 | A | 6/2009 |
| JP | 2012-166374 | A | 9/2012 |
| JP | 2012-179583 | A | 9/2012 |
| JP | 2012-206393 | A | 10/2012 |
| JP | 2016-83877 | A | 5/2016 |
| JP | 2016-190360 | A | 11/2016 |
| JP | 2018-79684 | A | 5/2018 |
| JP | 2020-40365 | A | 3/2020 |
| WO | 2020/153326 | A1 | 7/2020 |

OTHER PUBLICATIONS

Japanese Office Action for the related Japanese Patent Application No. 2019-010590 dated Aug. 16, 2022.

Copy of International Preliminary Report On Patentability for PCT/JP2020/001848 dated Jul. 27, 2021.

International Search Report and Written Opinion of the International Search Report for PCT/JP2020/001848 dated Apr. 7, 2020.

* cited by examiner

LIQUID DISCHARGE APPARATUS

CROSS REFERENCE TO RELATED APPLICATIONS

The present application is a continuation of International Application No. PCT/JP2020/001848 filed on Jan. 21, 2020 which claims priority to Japanese Patent Application No. 2019-010590 filed on Jan. 24, 2019.

BACKGROUND

The present invention relates to a liquid discharge apparatus in which a wiper for wiping out a nozzle surface is cleaned by a cleaner.

A printing apparatus is known, in which the printing is performed such that the ink, which is discharged from nozzles of a printing head, adheres to a sheet. In such a printing apparatus, the maintenance called "purge" is performed in some cases, in which the ink is forcibly discharged from the head. The ink adheres to a nozzle surface of the head after performing the purge. The ink, which adheres to the nozzle surface, is wiped out by a wiper. Further, a cleaner is provided in order to clean out the ink adhered to the wiper.

SUMMARY

In order to clean up the wiper, the wiper is relatively moved, while being maintained in a state in which the wiper is brought in contact with the cleaner. In order to reliably clean up the wiper, it is preferable that the relative movement distance between the wiper and the cleaner is long. However, if the relative movement distance between the wiper and the cleaner is lengthened or prolonged, the space, which is secured in the apparatus in order to move the wiper or the cleaner, is increased. As a result, a problem arises such that the apparatus is large-sized.

The present disclosure has been made taking the foregoing circumstances into consideration, an object of which is to provide means which makes it possible to prolong or lengthen the relative movement distance between a wiper and a cleaner while suppressing any large size of an apparatus.

According to an aspect of the present disclosure, there is provided a liquid discharge apparatus including: a head including a nozzle surface in which a plurality of nozzles are opened; a wiper including a blade and a blade holder supporting the blade; a posture changer configured to change a posture of the blade between a first posture in which the blade is capable of contacting the nozzle surface of the head and a second posture which is different from the first posture; and a cleaner including a cleaning surface intersecting the nozzle surface. The blade in the first posture is configured to move in a first sliding direction relatively with respect to the head in a state in which the blade contacts the nozzle surface. The blade in the second posture is configured to move in a second sliding direction intersecting the first sliding direction relatively with respect to the cleaner in a state in which the blade contacts the cleaning surface.

DETAILED DESCRIPTION

Figure 1:
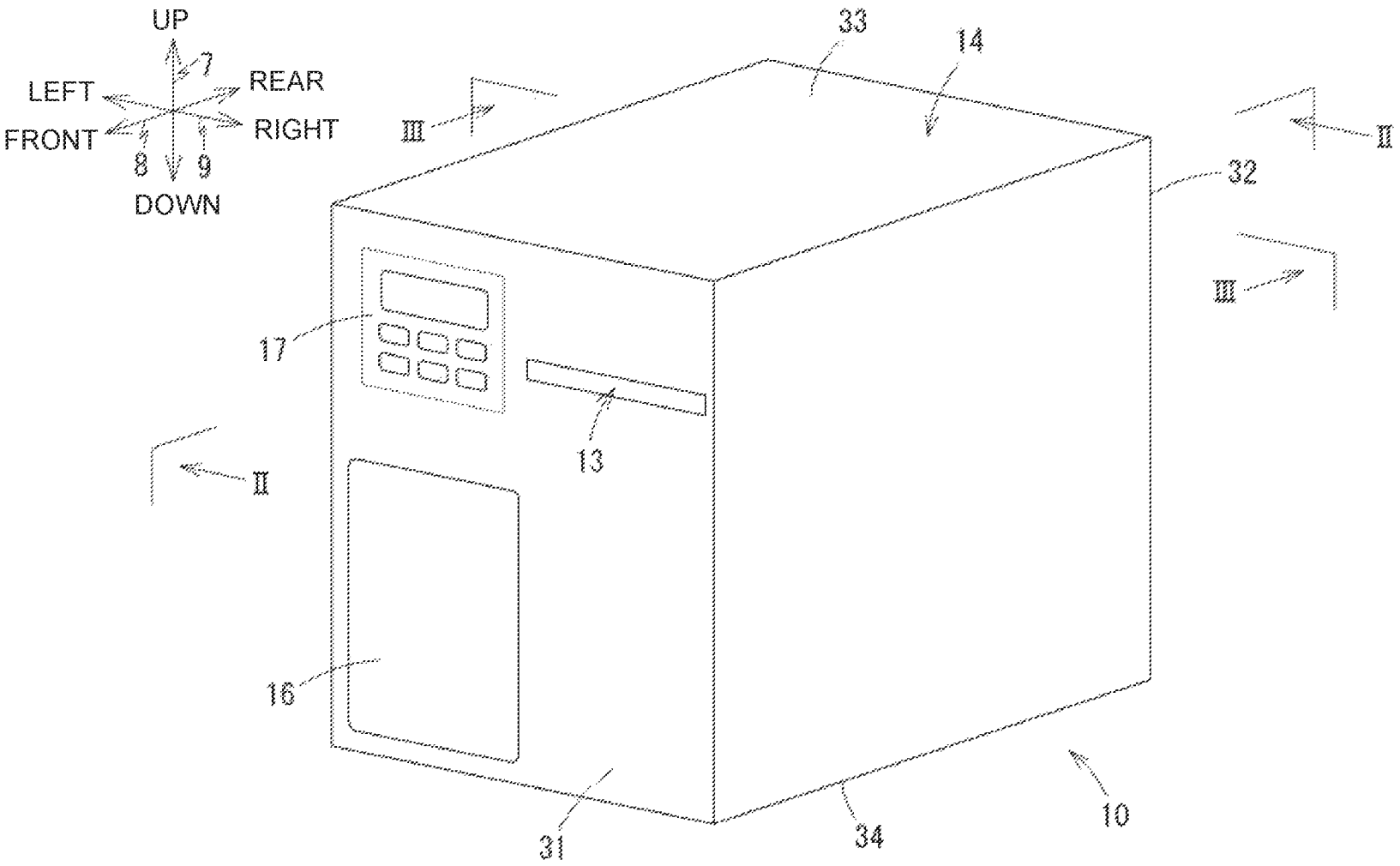
FIG. 1 depicts a perspective view illustrating those disposed on the side of a front wall 31 of a printing apparatus 10.

An explanation will be made below about a printing apparatus 10 according to an embodiment of the present disclosure. It goes without saying that the embodiment explained below is merely an example of the present disclosure, and the embodiment can be appropriately changed within a range without changing the gist or essential characteristics of the present disclosure. Further, in the following explanation, the advance, which is directed from the start point to the end point of the arrow, is expressed as "orientation", and the displacement (coming and going) on the line to connect the start point to the end point of the arrow is expressed as "direction". Further, in the following explanation, the up-down direction 7 is defined on the basis of the state (state depicted in FIG. 1) in which the printing apparatus 10 is installed usably. The front-rear direction 8 is defined assuming that the side, on which a discharge port 13 is provided, is the front side (front surface). The left-right direction 9 is defined while viewing the printing apparatus 10 from the front side (front surface).

[Appearance Structure of Printing Apparatus 10]

As depicted in FIG. 1, the printing apparatus 10 (example of the liquid discharge apparatus) records an image, for example, on the roll paper 11 (see FIG. 2) in accordance with the ink-jet recording system. A casing 14 generally has a rectangular parallelepiped shape in which the discharge port 13 is formed on a front wall 31. The discharge port 13 is positioned at a right portion of the front wall 31. The casing 14 has a size capable of being placed on a desk or table. That is, the printing apparatus 10 is suitable for the use in which the printing apparatus 10 is placed on the desk or table. Of course, the printing apparatus 10 may be used while being placed on a floor surface.

An operation panel 17 is positioned at the left of the discharge port 13 on the front wall 31. The operation panel 17 has, for example, a display and input keys. A user performs the input in order to operate the printing apparatus 10 and determine various settings by means of the operation panel 17.

A cover 16 is provided under or below the operation panel 17. When the cover 16 is opened, the internal space of the casing 14 is exposed. A tank 70 (see FIG. 2) is positioned at the rear of the cover 16 as described later on. The cover 16, which is in a state of being closed, is a part of the front wall 31 of the casing 14.

[Internal Structure of Printing Apparatus 10]

Figure 3:
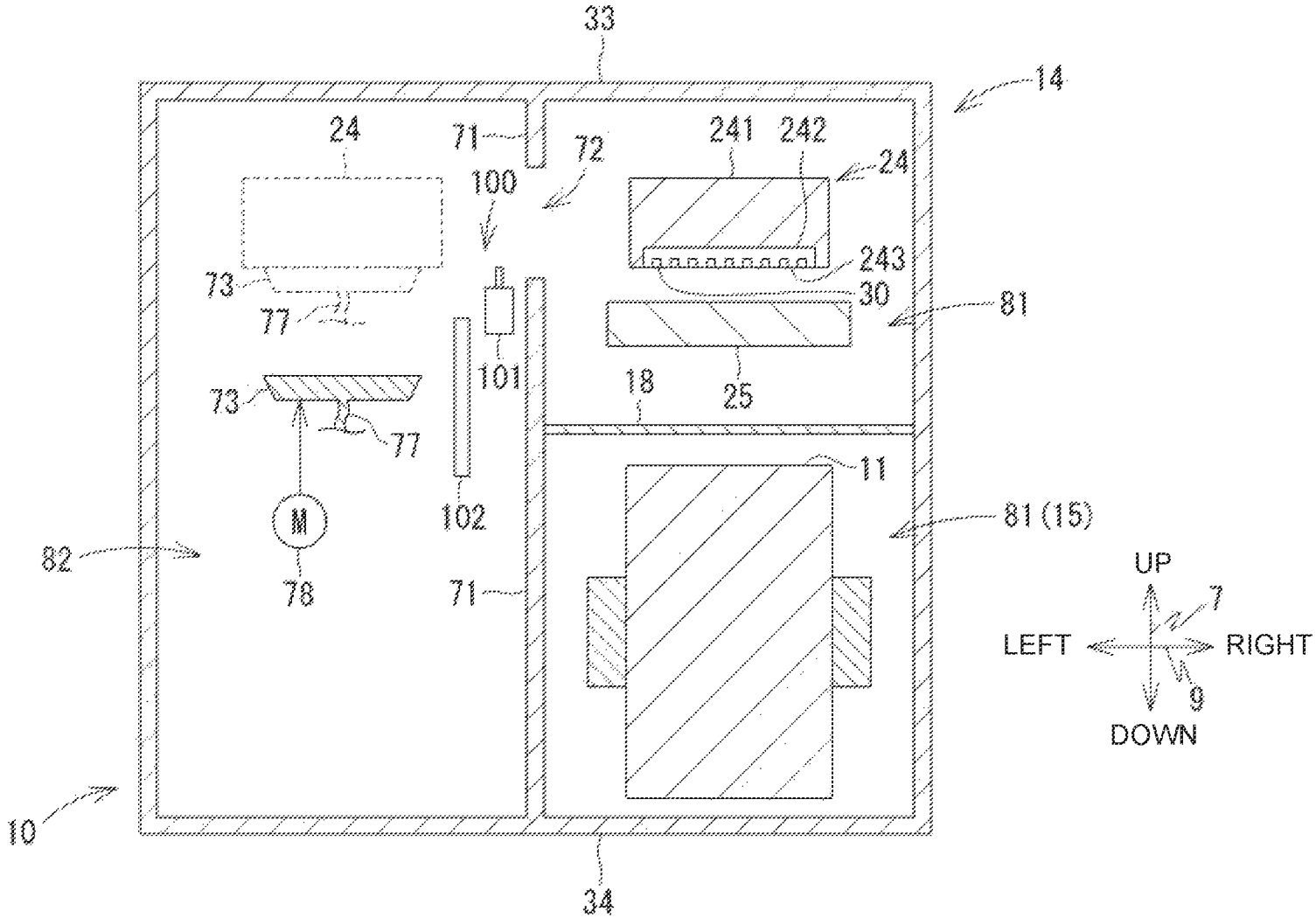
FIG. 3 schematically depicts a cross section taken along III-III depicted in FIG. 1.
Figure 4:
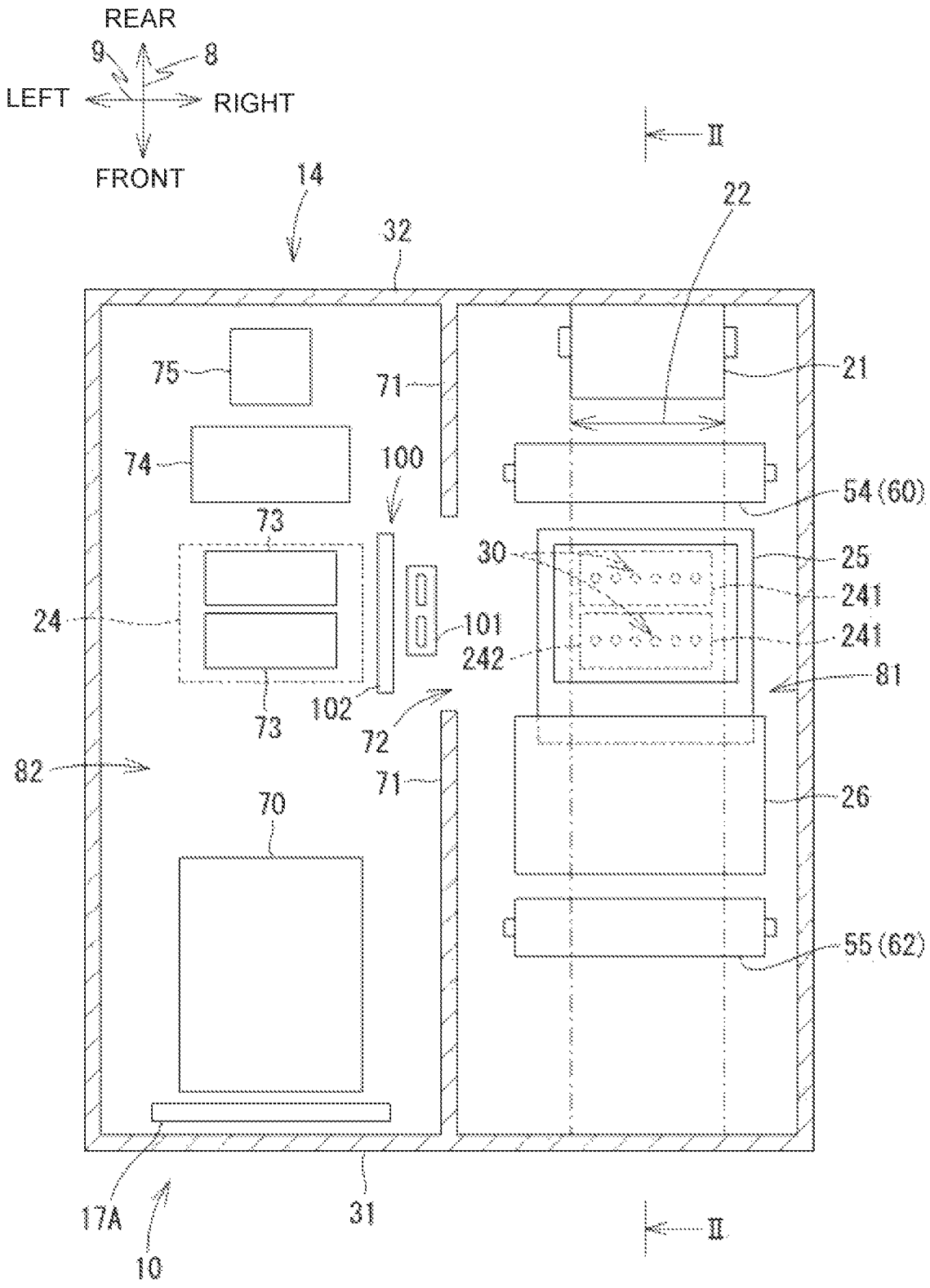
FIG. 4 schematically depicts an internal structure of the printing apparatus 10 as viewed in a direction directed to the downward.

As depicted in FIGS. 3 and 4, a partition wall 71 is provided in the internal space of the casing 14. The partition wall 71 is the wall which expands in the up-down direction 7 and the front-rear direction 8. In other words, the partition wall 71 extends in the up-down direction 7 and the front-rear direction 8. As depicted in FIG. 3, an upper end of the partition wall 71 is connected to an upper wall 33 of the casing 14, and a lower end of the partition wall 71 is connected to a lower wall 34 of the casing 14. As depicted in FIG. 4, a front end of the partition wall 71 is connected to a front wall 31 of the casing 14, and a rear end of the partition wall 71 is connected to a rear wall 32 of the casing 14.

The internal space of the casing 14 is composed of a first space 81 and a second space 82. The first space 81 is the portion of the internal space of the casing 14 disposed at the right of the partition wall 71. The second space 82 is the portion of the internal space of the casing 14 disposed at the left of the partition wall 71. In other words, the partition wall 71 is positioned between the first space 81 and the second space 82. The partition wall 71 has an opening 72. The first space 81 and the second space 82 are connected to one another via the opening 72.

As depicted in FIG. 4, a conveying passage 22 is formed in the first space 81. The roll paper 11 (see FIGS. 2 and 3), a feed roller 20 (see FIG. 2), a feed roller 21, a first conveying roller pair 54, a second conveying roller pair 55, a platen 25, and a heater 26 are arranged in the first space 81. A tank 70, caps 73, a control substrate 74, a power source circuit 75, and a maintenance unit 100 (example of the wiping apparatus) are arranged in the second space 82. The printing head 24 is provided with a carriage 241 and discharge modules 242 which are carried on the carriage 241. The carriage 241 is movable in the left-right direction 9. Therefore, the printing head 24 can be positioned in any one of the first space 81 and the second space 82.

Figure 2:
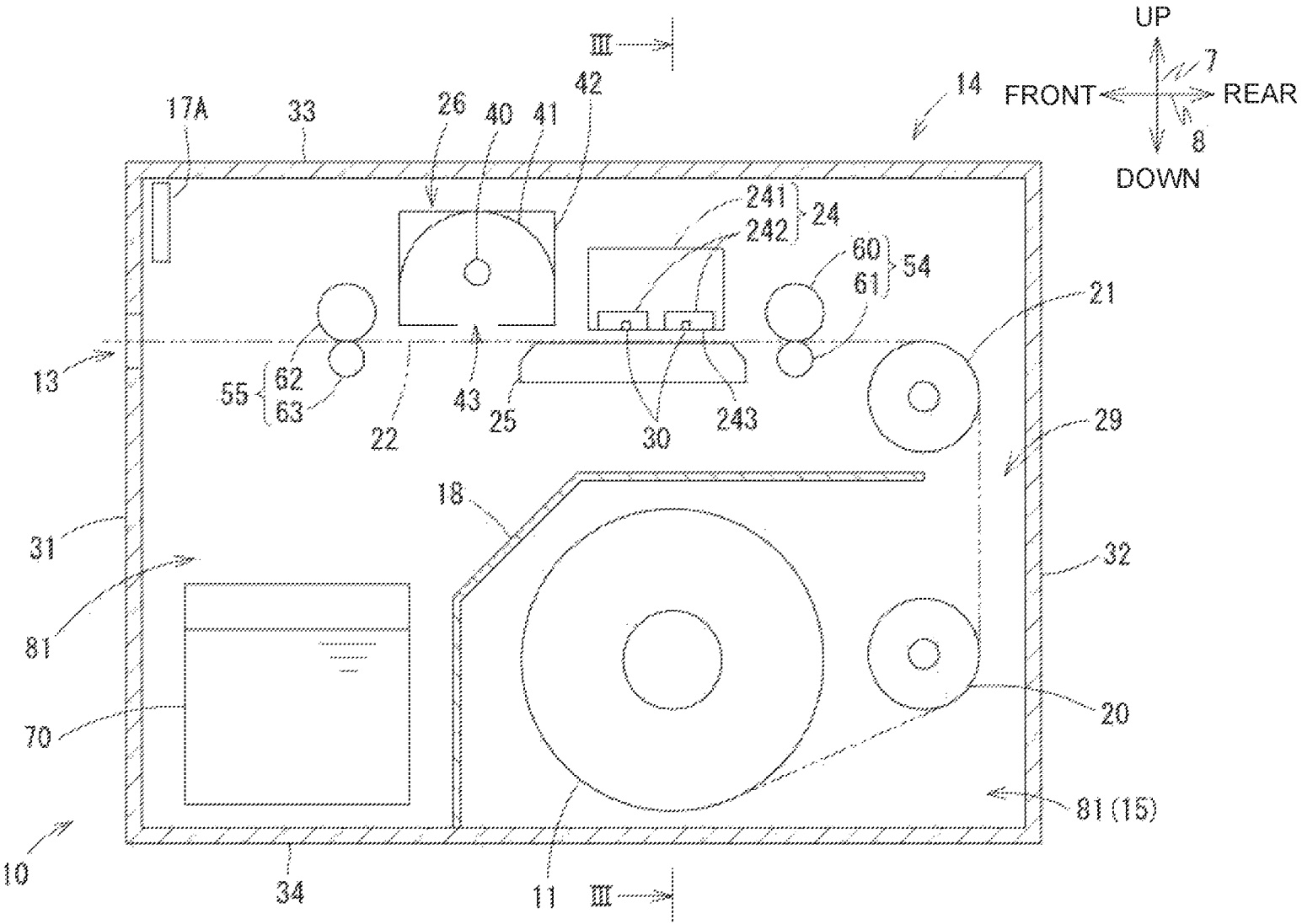
FIG. 2 schematically depicts a cross section taken along II-II depicted in FIG. 1.

As depicted in FIGS. 2 to 4, the printing head 24 has the two discharge modules 242. The two discharge modules 242 are arranged while being separated from each other in the front-rear direction 8 in the printing head 24. Each of the discharge modules 242 has a plurality of nozzles 30 which are arranged while being aligned in the left-right direction 9.

As depicted in FIG. 2, the first space 81 has a sheet accommodating space 15 in which the roll paper 11 can be accommodated. The sheet accommodating space 15 is formed at the rear portion of the first space 81. The sheet accommodating space 15 is the space which is defined by a partition wall 18. The roll paper 11 is accommodated in the sheet accommodating space 15 while the left-right direction 9 is the roll axis direction. The sheet accommodating space 15 is opened upwardly at the rear portion. A gap 29, through which the sheet drawn from the roll paper 11 can pass, is formed between the partition wall 18 and the rear wall 32.

The feed roller 20 is positioned in the sheet accommodating space 15. The feed roller 21 is positioned just over the sheet accommodating space 15 in the first space 81. The sheet, which is drawn backwardly from the roll paper 11, is wound around the feed roller 20, and the sheet extends upwardly. Further, the sheet is wound around the feed roller 21, and the sheet extends frontwardly. The uppermost position of the circumference surface of the feed roller 21 is equivalent to the discharge port 13 in the up-down direction 7.

As depicted in FIGS. 2 and 4, the conveying passage 22 is formed to range over the feed roller 21 and the discharge port 13. The conveying passage 22 extends substantially in a straight form. The conveying passage 22 is the space through which the sheet can pass. Although not depicted in detail in the respective drawings, the conveying passage 22 is defined, for example, by guide members which are positioned separately in the up-down direction 7, the printing head 24, the platen 25, and the heater 26. The frontward orientation is the conveying orientation in the conveying passage 22.

As depicted in FIG. 2, the first conveying roller pair 54 is provided upstream in the conveying orientation from the printing head 24 in the conveying passage 22. The first conveying roller pair 54 has a first conveying roller 60 and a pinch roller 61. The second conveying roller pair 55 is provided downstream in the conveying orientation from the heater 26 in the conveying passage 22. The second conveying roller pair 55 has a second conveying roller 62 and a pinch roller 63. The first conveying roller 60 and the second conveying roller 62 are rotated by the transmission of the rotation of a motor (not depicted). The first conveying roller pair 54 and the second conveying roller pair 55 convey the sheet in the conveying orientation in accordance with the rotation of the first conveying roller 60 and the second conveying roller 62 in a state in which the sheet extending from the roll paper 11 is interposed between the respective rollers for constructing the first conveying roller pair 54 and the second conveying roller pair 55.

The printing head 24, the platen 25, and the heater 26 are positioned in the conveying passage 22 between the first conveying roller pair 54 and the second conveying roller pair 55. Further, any other conveying roller is not positioned in the conveying passage 22 between the first conveying roller pair 54 and the second conveying roller pair 55.

The carriage 241 is supported by a pair of guide rails (not depicted) which are arranged while providing a spacing distance in the front-rear direction 8 in the internal space of the casing 14. The respective rails of the pair of guide rails extend to range over from the first space 81 to the second space 82. The opening 72 is positioned between the pair of guide rails in the front-rear direction 8. The carriage 241 is connected to a motor (not depicted) by the aid of a known belt mechanism. Accordingly, the carriage 241 is movable in the left-right direction 9 together with the discharge module 242. Note that any known configuration is adoptable other than the belt mechanism as the configuration to move the carriage 241. The carriage 241, which is movable in the left-right direction 9, is an example of the head moving mechanism.

The conveying passage 22 extends in the front-rear direction 8 at the position opposed in the up-down direction 7 to the printing head 24. In other words, the left-right direction 9, in which the printing head 24 is to be moved, is orthogonal to the front-rear direction 8 in which the conveying passage 22 extends. Note that it is enough that the direction, in which the printing head 24 is to be moved, intersects the direction in which the conveying passage 22 extends. It is not necessarily indispensable that the direction, in which the printing head 24 is to be moved, is orthogonal to the direction in which the conveying passage 22 extends.

The printing head 24 is movable to the first position which is indicated by solid lines in FIGS. 3 and 4 and the second position which is indicated by broken lines in FIGS. 3 and 4. The printing head 24, which is disposed at the first position, is positioned in the first space 81. The printing head 24, which is disposed at the second position, is positioned in the second space 82. The printing head 24 passes through the opening 72 when the printing head 24 is moved from the first position to the second position and when the printing head 24 is moved from the second position to the first position. In other words, the opening 72 has a size through which the printing head 24 can pass.

The printing head 24, which is disposed at the first position, is opposed to the platen 25 while interposing the conveying passage 22 at the downstream in the conveying orientation from the first conveying roller pair 54. The printing head 24, which is disposed at the first position, is positioned over or above the platen 25 and the conveying passage 22. The printing head 24, which is disposed at the second position, is retracted leftwardly from the conveying passage 22. The printing head 24, which is disposed at the second position, is positioned over or above the caps 73 while being opposed to the caps 73. The arrangement of the two caps 73 corresponds to the arrangement of the two discharge modules 242 of the printing head 24 disposed over or above the caps 73.

The printing head 24 discharges the ink from the plurality of nozzles 30 (example of the nozzles) toward the conveying passage 22 and the platen 25 (or the sheet supported by the platen 25) when the printing head 24 is disposed at the first position. The printing head 24 discharges the ink from the plurality of nozzles 30 toward the space in the cap 73 when the printing head 24 is disposed at the second position.

As depicted in FIG. 4, the plurality of nozzles 30 are formed while being aligned in the left-right direction 9 on the lower surface of the discharge module 242. Note that in FIG. 4, as for the plurality of nozzles 30, only one array is depicted in relation to each of the discharge modules. However, as for the plurality of nozzles 30, a plurality of arrays are provided in the conveying orientation in relation to one discharge module 242. When the printing head 24 is positioned at the first position, the both ends in the left-right direction 9 of the plurality of nozzles 30 are opposed to the both ends in the left-right direction 9 of the conveying passage 22. As depicted in FIG. 4, the tank 70 is positioned at the rear of the cover 16 in the second space 82. The ink is stored in the tank 70. Although not depicted in the drawings, the ink is supplied from the tank 70 via a tube 76 to the printing head 24.

The ink is a liquid containing, for example, a pigment and resin fine particles, and the ink is a so-called latex ink. The ink has a viscosity suitable to disperse the pigment and the resin fine particles uniformly or homogeneously. The pigment forms the color of the ink. The resin fine particles are provided for the pigment to adhere to the sheet. The resin fine particles are based on, for example, a synthetic resin in which the glass transition temperature is exceeded by being heated by the heater 26. The latex ink has a composition containing other known components.

As depicted in FIGS. 2 and 3, the platen 25 is positioned under or below the printing head 24 disposed at the first position. The platen 25 has its upper surface which is the support surface for the sheet. Although not depicted in the respective drawings, openings, which generate the suction pressure, are formed on the upper surface of the platen 25. The sheet makes tight contact with the upper surface of the platen 25 by the suction pressure generated on the upper surface of the platen 25.

The printing head 24, which is disposed at the second position, is positioned over or above the cap 73 while being opposed to the cap 73.

The cap 73 is connected to a motor 78 via a transmission gear and a cam. The cap 73 is movable in the up-down direction 7 by the driving force transmitted from the motor 78. In particular, the cap 73 is movable to a cap position which is indicated by broken lines in FIG. 3 and an uncap position which is indicated by solid lines in FIG. 3. The cap 73, which is disposed at the cap position, makes tight contact with the lower surface of the printing head 24 from a downward position, and the cap 73 covers the plurality of nozzles from the downward position. The state of the cap 73 and the printing head 24, which is provided in this situation, is the cap state. The uncap position is disposed under or below the cap position. The cap 73, which is disposed at the uncap position, is separated from the plurality of nozzles 30. In this situation, the plurality of nozzles 30 are exposed without being covered with the caps 73. The state of the cap 73 and the printing head 24, which is provided in this situation, is the uncap state. The upper end of the cap 73 disposed at the uncap position is positioned under or below the opening 72.

Note that the opening 72 is not limited to the structure in which the opening 72 is comparted by the partition wall 71 at all of the upward and downward boundaries and the front and rear boundaries (i.e., the through-hole formed through the partition wall 71). For example, the opening 72 may be a cutout which is cut out downwardly from the upper end of the partition wall 71.

One end of a tube 77 is connected to the cap 73. The tube 77 is a resin tube which has flexibility. The other end of the tube 77 is connected to a waste ink tank (not depicted). When the cap 73 is positioned at the cap position, if the ink is discharged from the nozzles 30 in a blank manner, then the ink is discharged to the waste ink tank via the tube 77.

As depicted in FIG. 2, the heater 26 is positioned downstream from the printing head 24 and upstream from the second conveying roller pair 55 over or above the conveying passage 22.

As depicted in FIG. 4, the heater 26 is positioned downstream in the conveying orientation from the opening 72. In other words, the heater 26 and the opening 72 are positioned while being deviated from each other in the conveying orientation.

The heater 26 is a so-called halogen heater. As depicted in FIG. 2, the heater 26 has a halogen lamp 40 which is a heat generating element for radiating the infrared ray, a reflecting plate 41, and a casing 42. The casing 42 generally has a rectangular parallelepiped shape. An opening 43, which extends in the left-right direction 9, is formed at the lower wall of the casing 42. The heat, which comes from the halogen lamp 40 and the reflecting plate 41, is radiated to the outside via the opening 43. The halogen lamp 40 is positioned in the internal space of the casing 42. The halogen lamp 40 has a slender cylindrical shape, in which the left-right direction 9 is the longitudinal direction. The reflecting plate 41 is positioned over or above the halogen lamp 40 in the internal space of the casing 42. The reflecting plate 41 is a metal plate which is coated, for example, with a ceramic film. The reflecting plate 41 is curved in a circular arc-shaped form in which the central axis is disposed in the vicinity of the opening 43. Note that a halogen lamp 40, which is coated with a ceramic film or the like, may be used in place of the reflecting plate 41.

The heater 26 heats at least one of the sheets which passes under or below the opening 43 and the ink which adheres to the sheet. In this embodiment, the heater 26 heats both of the sheet and the ink. When the ink is heated, the resin fine particles are subjected to the glass transition thereby. The sheet, which has passed under or below the heater 26, is cooled, the resin having been subjected to the glass transition, is cured thereby. Accordingly, the ink is fixed to the sheet.

Further, as depicted in FIG. 2, a substrate 17A, which is connected to the operation panel 17, is provided at the rear of the operation panel 17.

As depicted in FIG. 4, the control substrate 74 and the power source circuit 75 are arranged in the second space 82. Note that the arrangement positions of the control substrate 74 and the power source circuit 75 depicted in FIG. 4 are referred to by way of example. The control substrate 74 and the power source circuit 75 may be arranged at arbitrary positions in the second space 82.

The control substrate 74 is the substrate (circuit board) which is composed of glass epoxy or the like. Further, a control circuit, which is composed of, for example, CPU, ROM, RAM, and ASIC, is mounted on the control substrate 74. CPU executes the program stored in ROM, and ASIC performs the set and specified function. Thus, the operation or action of the printing apparatus 10 is controlled.

The power source circuit 75 is the circuit which is composed of a large capacity capacitor or the like. In this embodiment, the power source circuit 75 is mounted on a substrate composed of, for example, paper phenol. The power source circuit 75 is the circuit which performs, for example, the conversion of the electric power in order to supply the electric power to the respective constitutive components provided for the printing apparatus 10.

[Maintenance Unit 100]

As depicted in FIGS. 3 and 4, the maintenance unit 100 is positioned between the first position and the second position to which the printing head 24 is to be moved, in the second space 82. The maintenance unit 100 removes the ink adhered to the lower surface of the discharge module 242 on which the nozzles 30 are open in the printing head 24, i.e., the nozzle surface 243. For example, if the printing head 24 discharges the ink into the cap 73 from the nozzles 30 at the second position, or if the ink is sucked from the nozzles 30 by providing the negative pressure in the cap 73, then the ink adheres to the nozzle surface 243. The ink is removed from the nozzle surface 243 by means of the maintenance unit 100.

Figure 5:
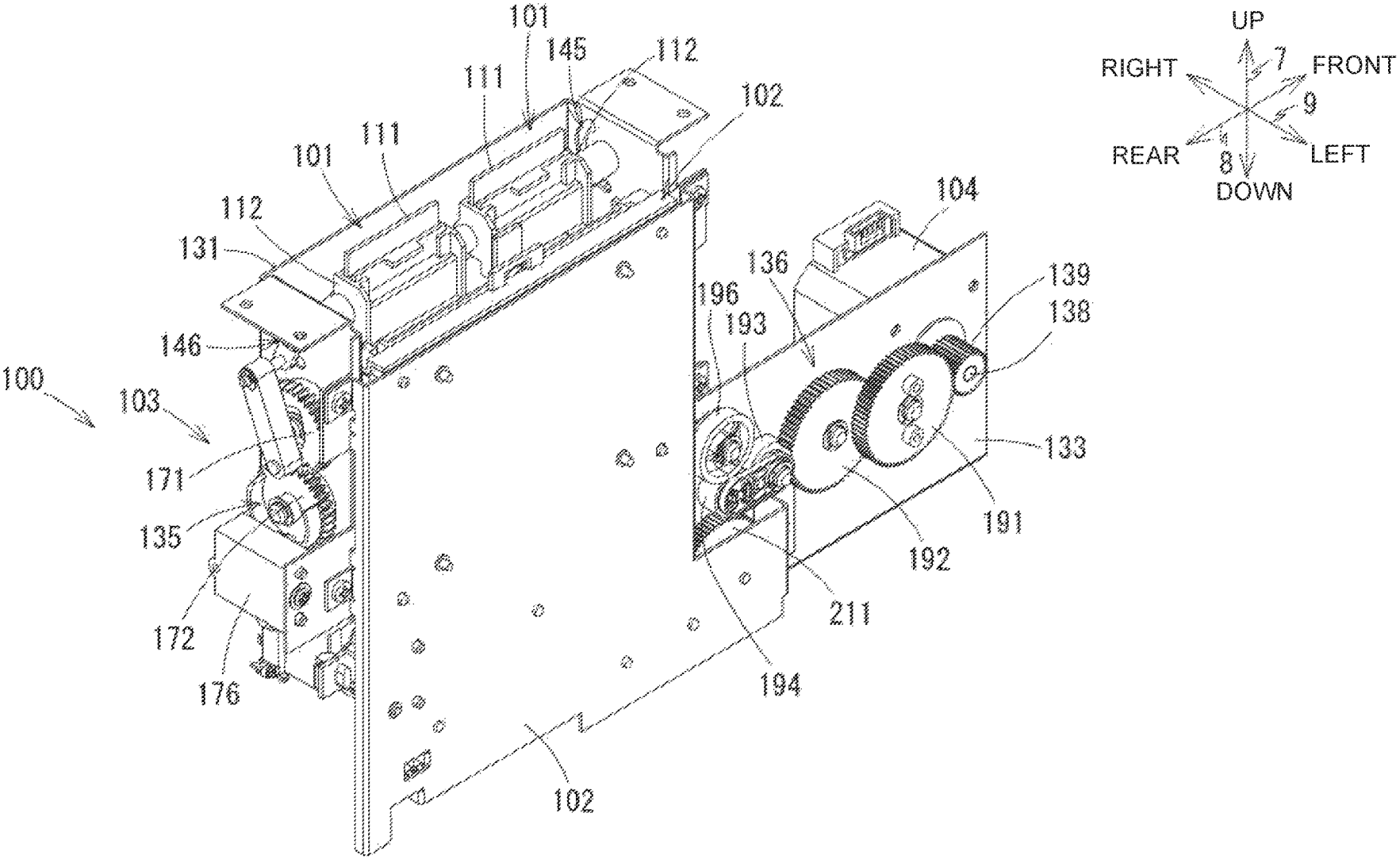
FIG. 5 depicts a perspective view illustrating an appearance of a maintenance unit 100.

As depicted in FIG. 5, the maintenance unit 100 has wipers 101, a cleaner 102, and a rotating mechanism 103 (example of the posture changer). The two wipers 101 are aligned in the front-rear direction 8. The respective wipers 101 correspond to the arrangement of the nozzles 30 of the printing head 24. If the plurality of nozzles 30 of the printing head 24 are divided into two groups in the front-rear direction 8, the nozzle surfaces 243, which are disposed in the vicinity of the two groups of the nozzles 30, are wiped out by the respective wipers 101, i.e., by the two wipers 101 aligned in the front-rear direction 8 as described in this embodiment. Note that the number of the wiper 101 or wipers 101 may be one or three or more depending on the arrangement of the nozzles 30 of the printing head 24. When the plurality of wipers 101 are provided, one wiper 101 can be small-sized. As for the wiper 101 having the small size, any strain in the forming process and any deformation during the rotation hardly occur.

Figure 6:
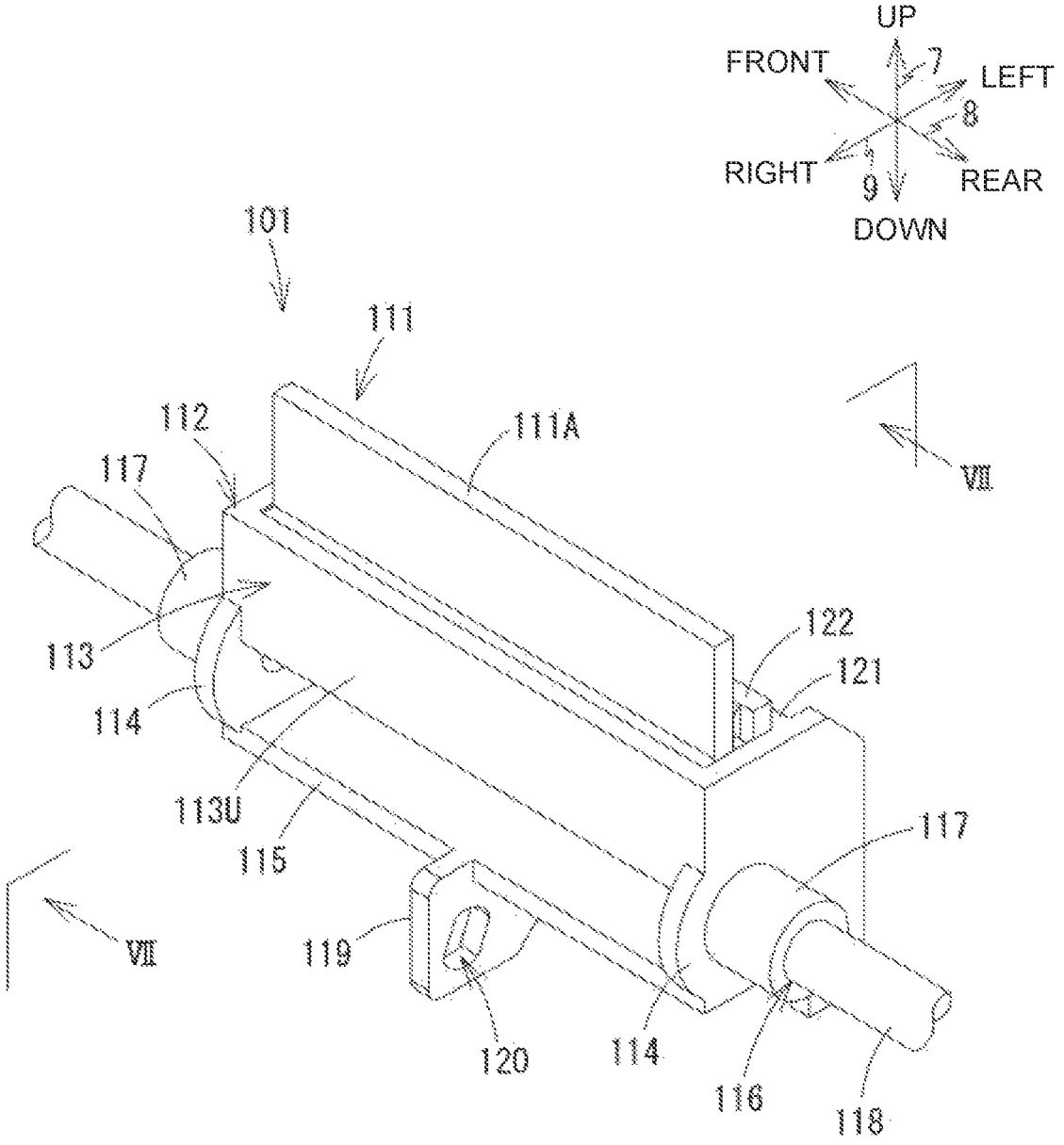
FIG. 6 depicts a perspective view illustrating an appearance of a wiper 101.
Figure 7:
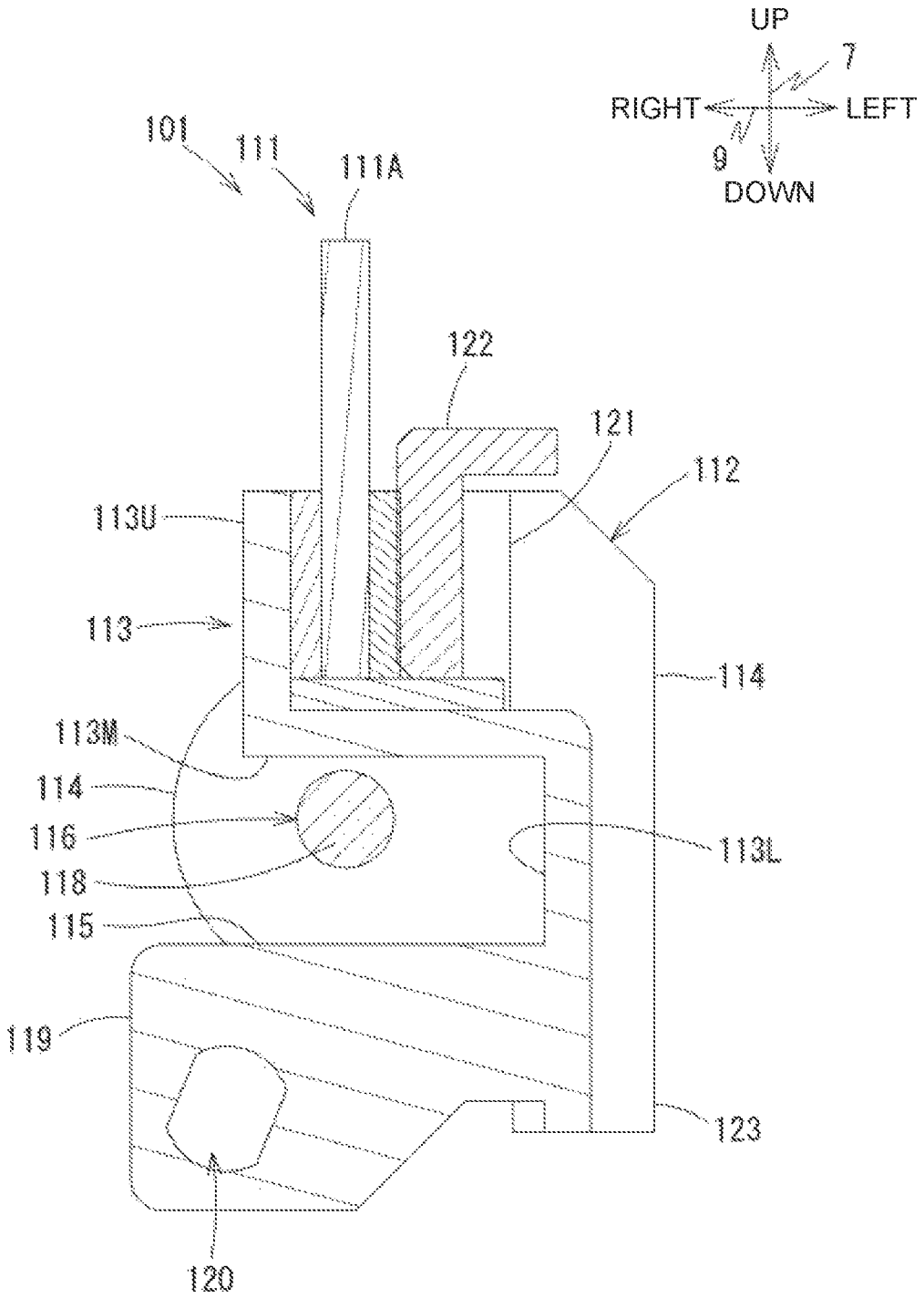
FIG. 7 depicts a sectional view illustrating a cross section taken along VII-VII depicted in FIG. 6.

The two wipers 101 have the same shape. Therefore, the configuration will be explained in detail with reference to an example of one wiper 101 depicted in FIGS. 6 and 7. The wiper 101 has a blade 111 and a blade holder 112. FIGS. 5 and 6 depict the wipers 101 in the first posture.

The blade 111 has a flat plate shape having a thin thickness. The blade 111 is composed of a material which is easily elastically deformable, including, for example, rubber and elastomer resin. The blade 111 has one end 111A (example of the forward end portion) which protrudes from the blade holder 112, the one end 111A being disposed in the front-rear direction 8. That is, the one end 111A extends in the front-rear direction 8.

The blade holder 112 is a formed product made of synthetic resin for supporting the blade 111. The blade holder 112 has a partition wall 113 which has a crank-shaped cross-sectional shape depicted in FIG. 7, two lateral walls 114 which are positioned at both ends in the front-rear direction 8 of the partition wall 113 respectively, and a bottom wall 115 which connects lower ends of the lateral walls 114 and the partition wall 113.

The partition wall 113 has an upper portion 113U, a middle portion 113M, and a lower portion 113L. In the wiper 101 in the first posture, the upper portion 113U expands in the up-down direction 7 and the front-rear direction 8. The middle portion 113M extends leftwardly in the left-right direction 9 from the lower end of the upper portion 113U, and the middle portion 113M expands in the front-rear direction 8 and the left-right direction 9. The lower portion 113L extends downwardly in the up-down direction 7 from the lower end of the middle portion 113M, and the lower portion 113L expands in the up-down direction 7 and the front-rear direction 8. The upper portion 113U and the lower portion 113L are parallel to one another. The middle portion 113M is orthogonal to the upper portion 113U and the lower portion 113L.

The blade 111 extends upwardly in the up-down direction 7 along the upper portion 113U from the upper surface of the middle portion 113M. Respective sizes or dimensions of the upper portion 113U, the middle portion 113M, and the lower portion 113L in the front-rear direction 8 are equal to one another. Therefore, the respective ends in the front-rear direction 8 of the upper portion 113U, the middle portion 113M, and the lower portion 113L form one plane at the both ends in the front-rear direction 8 respectively.

The two lateral walls 114 have flat plate-shaped forms in which the front-rear direction 8 is the thickness direction. The two lateral walls 114 are connected to the respective ends in the front-rear direction 8 of an upper portion 113U, a middle portion 113M, and a lower portion 113L of the partition wall 113. The two lateral walls 114 protrude leftwardly in the left-right direction 9 from the partition wall 113 respectively, and the two lateral walls 114 protrude rightwardly in the left-right direction 9 from the middle portion 113M and the lower portion 113L respectively. Further, the lower ends of the two lateral walls 114 are positioned over or above the lower end of the lower portion 113L. Therefore, the respective lateral walls 114 have portions which extend downwardly from the both ends in the front-rear direction 8 of the middle portion 113M of the partition wall 113 respectively.

Ribs 123 extend in the left-right direction 9 from the both ends in the front-rear direction 8 of the lower portion 113L under or below the lower ends of the lateral walls 114 at the lower portion 113L of the partition wall 113. The ribs 123 continue to the lower ends of the lateral walls 114.

Through-holes 116, which penetrate through the lateral walls 114 in the front-rear direction 8, are formed at positions of the two lateral walls 114 under or below the middle portion 113M of the partition wall 113 and over or above the lower end of the lower portion 113L. Respective axes of the respective through-holes 116 formed through the respective lateral walls 114 are coincident with each other. Each of the lateral walls 114 has a cylindrical portion 117 which protrudes frontwardly or backwardly in the front-rear direction 8 from the through-hole 116, i.e., in the orientation in which the blade 111 does not exist. The axes of the respective cylindrical portions 117 are coincident with the axes of the respective through-holes 116.

One shaft 118 (example of the rotation shaft), which extends in the front-rear direction 8, is inserted into the respective through-holes 116 and the respective cylindrical portions 117. The one shaft 118 is inserted into the two blade holders 112. The respective blade holders 112 are fixed to the shaft 118. In other words, the shaft 118 integrally connects the two blade holders 112. The partition wall 113 is positioned between the blade 111 and the shaft 118 in the up-down direction 7.

The bottom wall 115 is positioned under or below the through-holes 116 of the lateral walls 114 and over or above the lower end of the lower portion 113L of the partition wall 113. The bottom wall 115 extends rightwardly in the left-right direction 9 from the lower portion 113L of the partition wall 113. The bottom wall 115 connects the respective lower ends of the two lateral walls 114. The bottom wall 115 is parallel to the middle portion 113M of the partition wall 113. The middle portion 113M of the partition wall 113 is positioned over or above the shaft 118 inserted into the through-holes 116. Further, the bottom wall 115 is positioned under or below the shaft 118.

A rib 119 protrudes downwardly in the up-down direction 7 from a position disposed in the vicinity of the center in the front-rear direction 8 of the bottom wall 115. The rib 119 protrudes rightwardly from the right end of the bottom wall 115. As for the rib 119, a through-hole 120, which penetrates through the rib 119 in the front-rear direction 8, is formed at a position disposed rightwardly from the right end of the bottom wall 115. The through-hole 120 is a slotted hole having a size or dimension in the radial direction of the through-hole 116 which is longer than a size or dimension in the circumferential direction of the through-hole 116. One input shaft 144 is inserted into the respective through-holes 116 of the two blade holders 112.

Each of the two lateral walls 114 has a rib 121 which extends in parallel to the upper portion 113U of the partition wall 113 and which protrudes in the orientation in which the blade 111 exists in the front-rear direction 8. The blade 111 is positioned between the upper portion 113U and the rib 121. Further, a fastener 122 is positioned between the blade 111 and the rib 121. Each of the ribs 121 regulates the fastener 122 from being moved leftwardly in the left-right direction 9. The blade 111 is fixed to the blade holder 112 by being interposed by the upper portion 113U and the fastener 122. The blade 111, which is fixed to the blade holder 112, is parallel to the upper portion 113U of the partition wall 113. Therefore, the blade 111 extends along the upper portion 113U.

The rotating mechanism 103 allows the blades 111 to cause the posture change to the first posture and the second posture by rotating the blade holders 112 about the shaft 118. The blade 111, which is in the first posture, can make contact with the nozzle surface 243 of the printing head 24 which is movable in the left-right direction 9. The blade 111, which is in the second posture, is parallel to the nozzle surface 243, and the blade 111 does not make contact with the nozzle surface 243.

As depicted in FIG. 5, the rotating mechanism 103 has a first frame 131, a second frame 132, and a third frame 133. The first frame 131 supports the wiper 101 and gear trains 134, 135. The second frame 132 supports the cleaner 102. The third frame 133 supports a motor 104 and a gear train 136. The gear train 136 transmits the driving of the motor 104 to the cleaner 102. The first frame 131, the second frame 132, and the third frame 133 are connected to one another.

Figure 8:
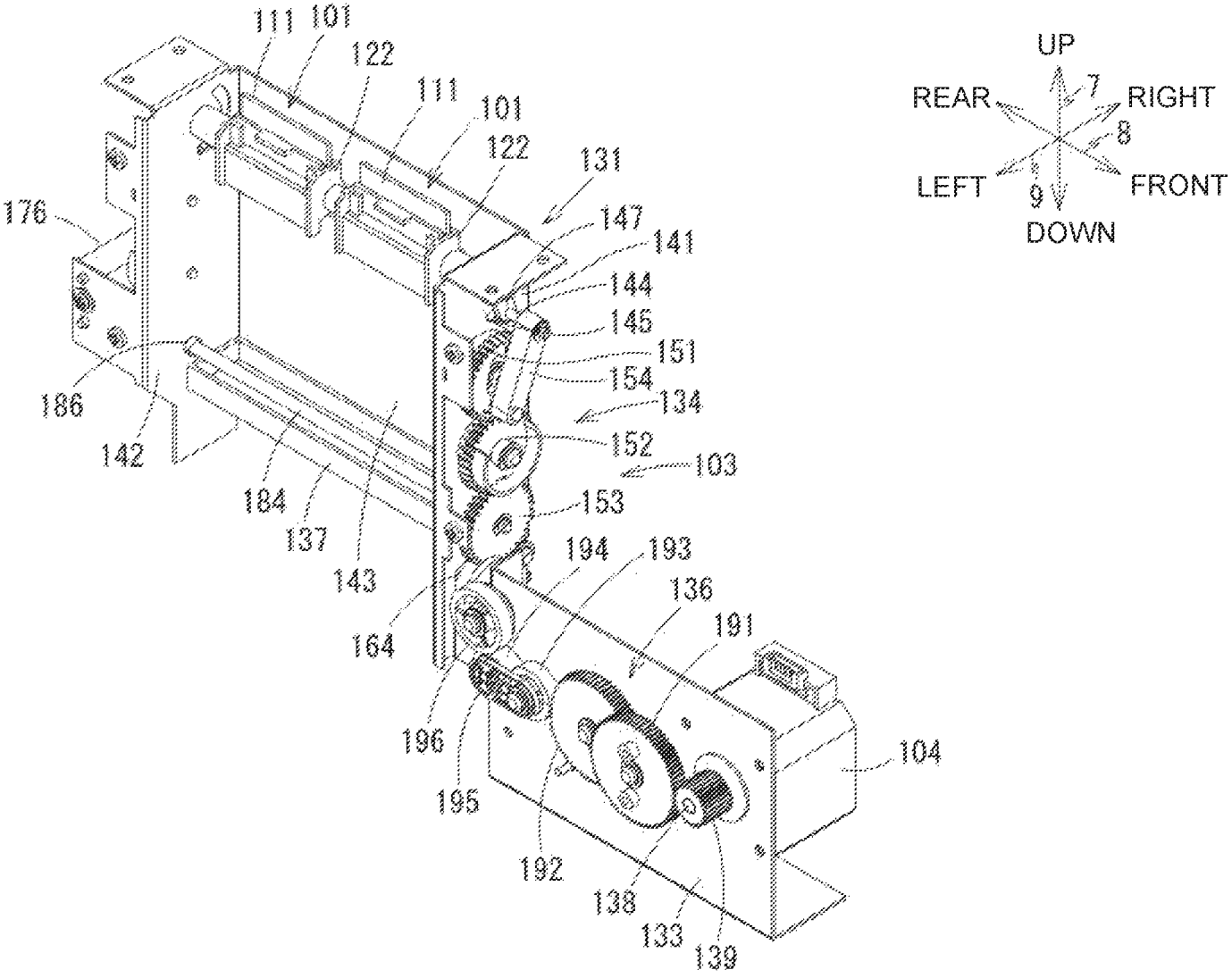
FIG. 8 depicts a perspective view illustrating appearances of a first frame 131 and a third frame 133.
Figure 9:
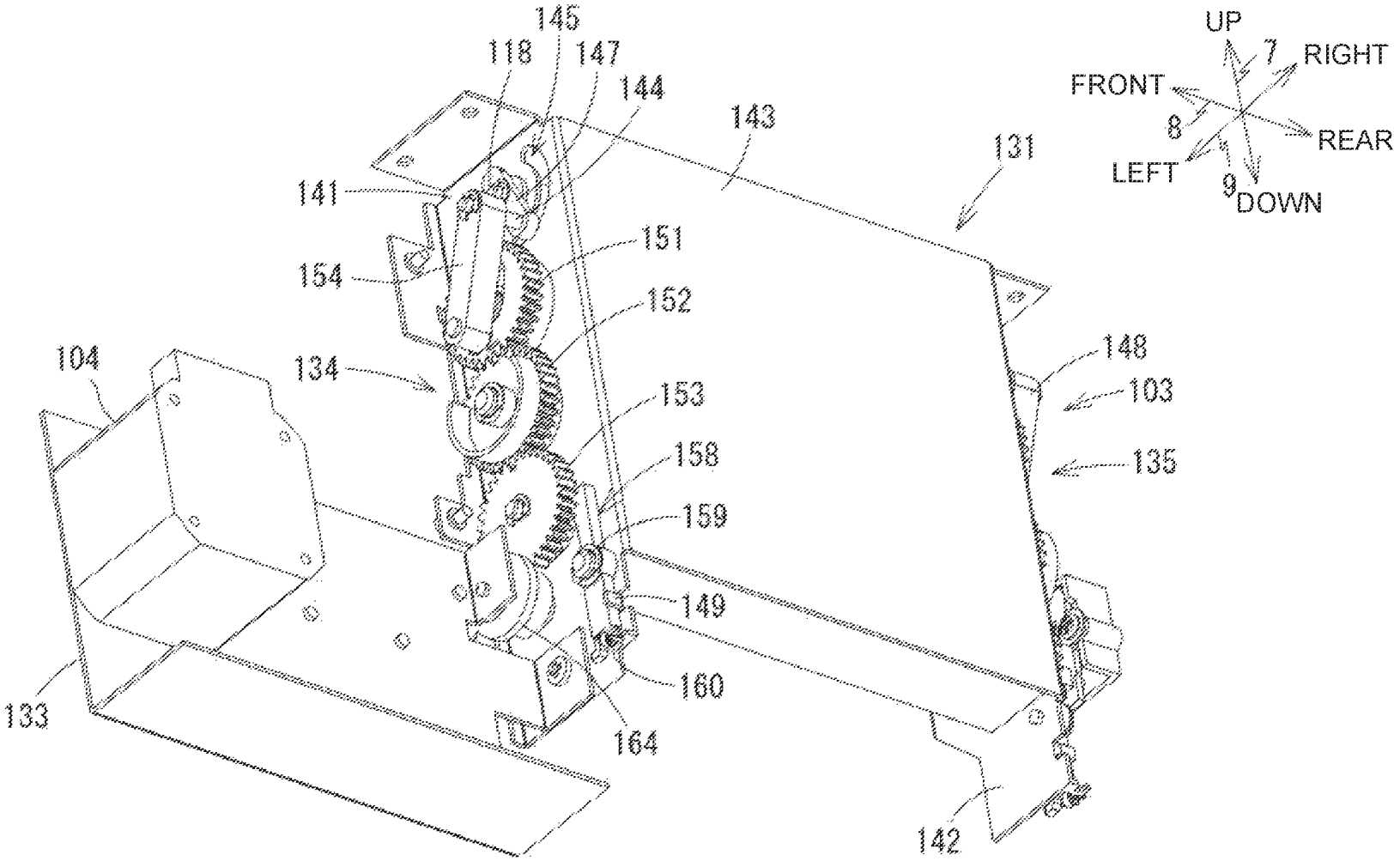
FIG. 9 depicts a perspective view illustrating the appearances of the first frame 131 and the third frame 133.

As depicted in FIGS. 8 and 9, the first frame 131 has a front wall 141, a rear wall 142, and a lateral wall 143. The front wall 141, the rear wall 142, and the lateral wall 143 are formed by folding or bending one sheet of metal plate. Further, the first frame 131 is appropriately formed with folded or bent portions in order to perform the connection with the second frame 132 and the third frame 133 and the connection with the casing 14, in addition to the front wall 141, the rear wall 142, and the lateral wall 143.

The front wall 141 and the rear wall 142 expand in the up-down direction 7 and the left-right direction 9. The front wall 141 and the rear wall 142 are parallel to one another, and they are separated from each other in the front-rear direction 8. The lateral wall 143 is continued to the right end of the front wall 141 and the right end of the rear wall 142.

The shaft 118, which is inserted into the blade holders 112, is inserted into through-holes which penetrate through the front wall 141 and the rear wall 142. The two blade holders 112 are positioned between the front wall 141 and the rear wall 142 in the front-rear direction 8. The two blade holders 112 are rotatable by using the rotation shaft of the shaft 118 which is rotatably supported by the front wall 141 and the rear wall 142.

As depicted in FIGS. 8 to 13, slits 145, 146 are formed through the front wall 141 and the rear wall 142 respectively. The slits 145, 146 extend in the circumferential direction of the shaft 118. The slits 145, 146 extend in the orientation in which the lateral wall 143 exists, from the positions disposed under or below the shaft 118, and the slits 145, 146 arrive at positions disposed obliquely upwardly with respect to the shaft 118.

Input shafts 144 are inserted into the slits 145, 146. When the blade 111 is subjected to the posture change to the first posture and the second posture, the input shafts 144 moves in the slits 145, 146. In other words, the slits 145, 146 extend along the movement loci of the input shafts 144.

The front end of the shaft 118 and the front end of the input shaft 144 are connected by a connecting member 147 in front of the front wall 141. The rear end of the shaft 118 and the rear end of the input shaft 144 are connected by a connecting member 148 at the rear of the rear wall 142.

A receiving pan 137 is positioned between the front wall 141 and the rear wall 142 in the front-rear direction 8. Further, the receiving pan 137 is positioned under or below the blade holders 112. The receiving pan 137 stores the ink allowed to drip down or flow down, for example, from the blades 111.

The gear train 134 is positioned on the front surface side of the front wall 141 (on the side opposite to the side on which the blade holders 112 exist). The front wall 141 supports the gear train 134. The gear train 135 is positioned on the rear surface side of the rear wall 142 (on the side opposite to the side on which the blade holders 112 exist).

The rear wall 142 supports the gear train 135. The gear trains 134, 135 transmit the rotation of the motor 104 to the input shafts 144 respectively.

Figure 12:
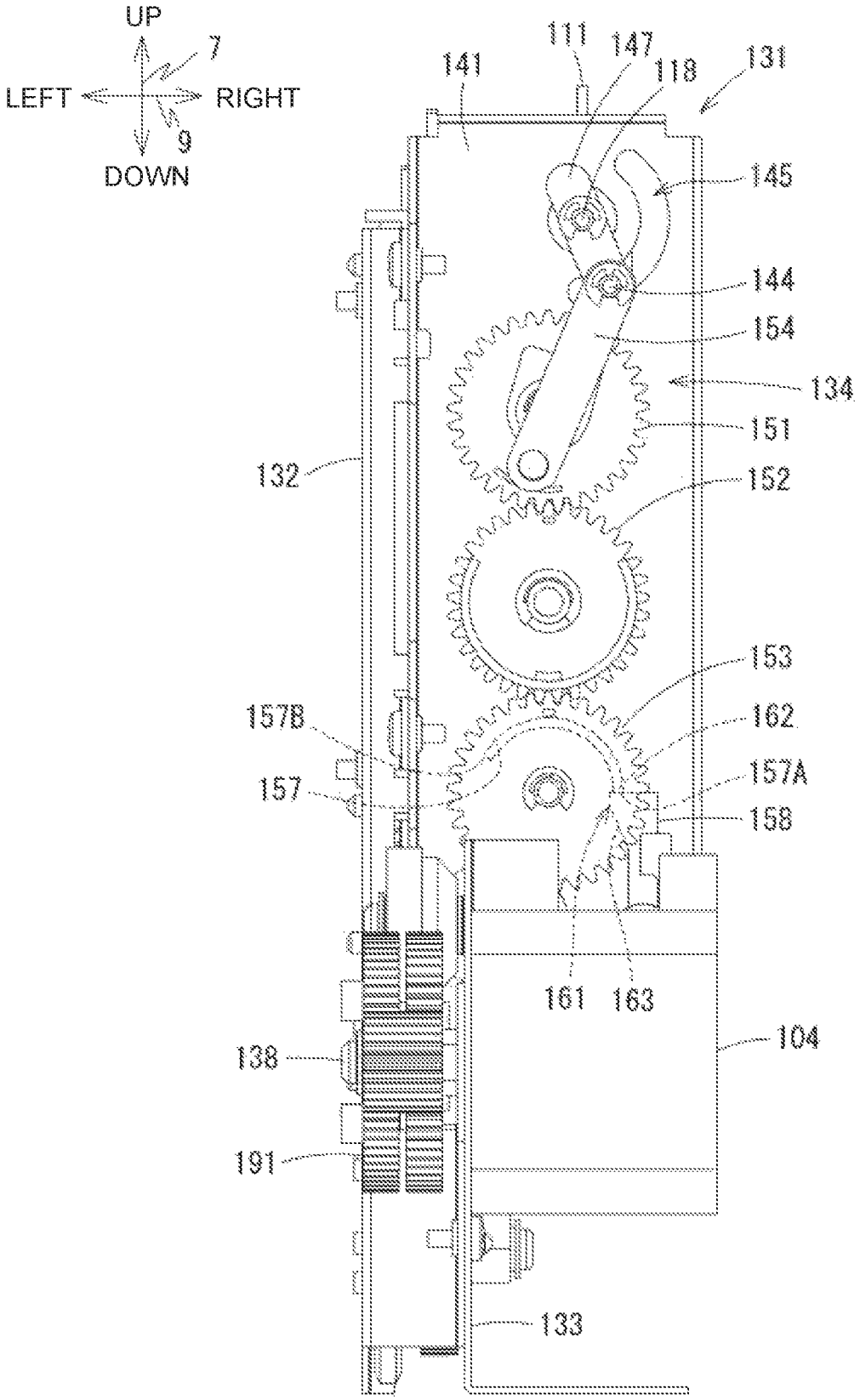
FIG. 12 depicts a front view illustrating front surfaces of the first frame 131 and the third frame 133.

As depicted in FIGS. 8, 9, and 12, the gear train 134 has three gears 151, 152, 153 which are meshed with each other in series, and a bevel gear 164. The gear 151 (example of the first gear) is positioned under or below the shaft 118 and the input shaft 144. The axis of the gear 151 is parallel to the axis of the shaft 118 and the axis of the input shaft 144. A connecting rod 154 connects a portion of the gear 151 separated in the radial direction from the axis and the front end of the input shaft 144. The connecting rod 154 transmits the rotation of the gear 151 as the reciprocating motion about the shaft 118 of the input shaft 144. The gear 151 and the connecting rod 154 are an example of the crank.

The gear 152 is positioned under or below the gear 151, and the gear 152 is meshed with the gear 151. The axis of the gear 152 is parallel to the axis of the shaft 118 and the axis of the input shaft 144.

The gear 153 is positioned under or below the gear 152, and the gear 153 is meshed with the gear 152. The axis of the gear 153 is parallel to the axis of the shaft 118 and the axis of the input shaft 144. As depicted by broken lines in FIG. 12, the gear 153 has a lock wall 157 which protrudes backwardly from the gear 153 in the circumferential direction of the gear 153, i.e., toward the front wall 141. The lock wall 157 exists at only a part of the gear 152 in the circumferential direction, and the lock wall 157 does not exist over the entire circumference. When a stopper 158 is engaged with the lock wall 157, the rotation of the gear 153 in one direction (clockwise rotation as viewed in FIG. 12) is regulated thereby. When the blade 111 is in the second posture, the stopper 158 is engaged with the lock wall 157.

As depicted in FIG. 9, the stopper 158 is supported by the front wall 141. The stopper 158 is rotatable about a shaft 159 which is disposed in parallel to the axis of the gear 153. An extension spring 160 is positioned between the lower end of the stopper 158 and the front wall 141. The extension spring 160 urges the stopper 158 counterclockwise as viewed in FIG. 12. As depicted in FIG. 9, an abutment wall 149 is formed on the front wall 141. The abutment wall 149 abuts against the lower end side of the stopper 158 to regulate the counterclockwise rotation of the stopper 158. The stopper 158 is rotatable clockwise as viewed in FIG. 12 against the urging force of the extension spring 160 as starting from the state in which the stopper 158 abuts against the abutment wall 149.

As depicted by broken lines in FIG. 12, a hook-shaped fastening section 161 is formed at the upper end of the stopper 158. The fastening section 161 has a lock surface 162 and a sliding surface 163. The lock surface 162 abuts against one end surface 157A in the circumferential direction of the lock wall 157, while being approximately orthogonal thereto. When the lock surface 162 abuts against the one end surface 157A in the circumferential direction of the lock wall 157, the rotation in one direction of the gear 153 is regulated thereby. The sliding surface 163 abuts against the other end surface 157B in the circumferential direction of the lock wall 157, while being not orthogonal thereto. When the gear 153 is rotated in the other direction (counterclockwise as viewed in FIG. 12) as starting from the state in which the sliding surface 163 abuts against the other end surface 157B of the lock wall 157, then the other end surface 157B of the lock wall 157 slides on the sliding surface 163, and the stopper 158 is rotated clockwise as viewed in FIG. 12 against the urging force of the extension spring 160.

As depicted in FIGS. 8 and 9, the bevel gear 164 is positioned under or below the gear 153, and the bevel gear 164 is meshed with the gear 153. The axis of the bevel gear 164 is parallel to the axis of the shaft 118 and the axis of the input shaft 144.

Figure 10:
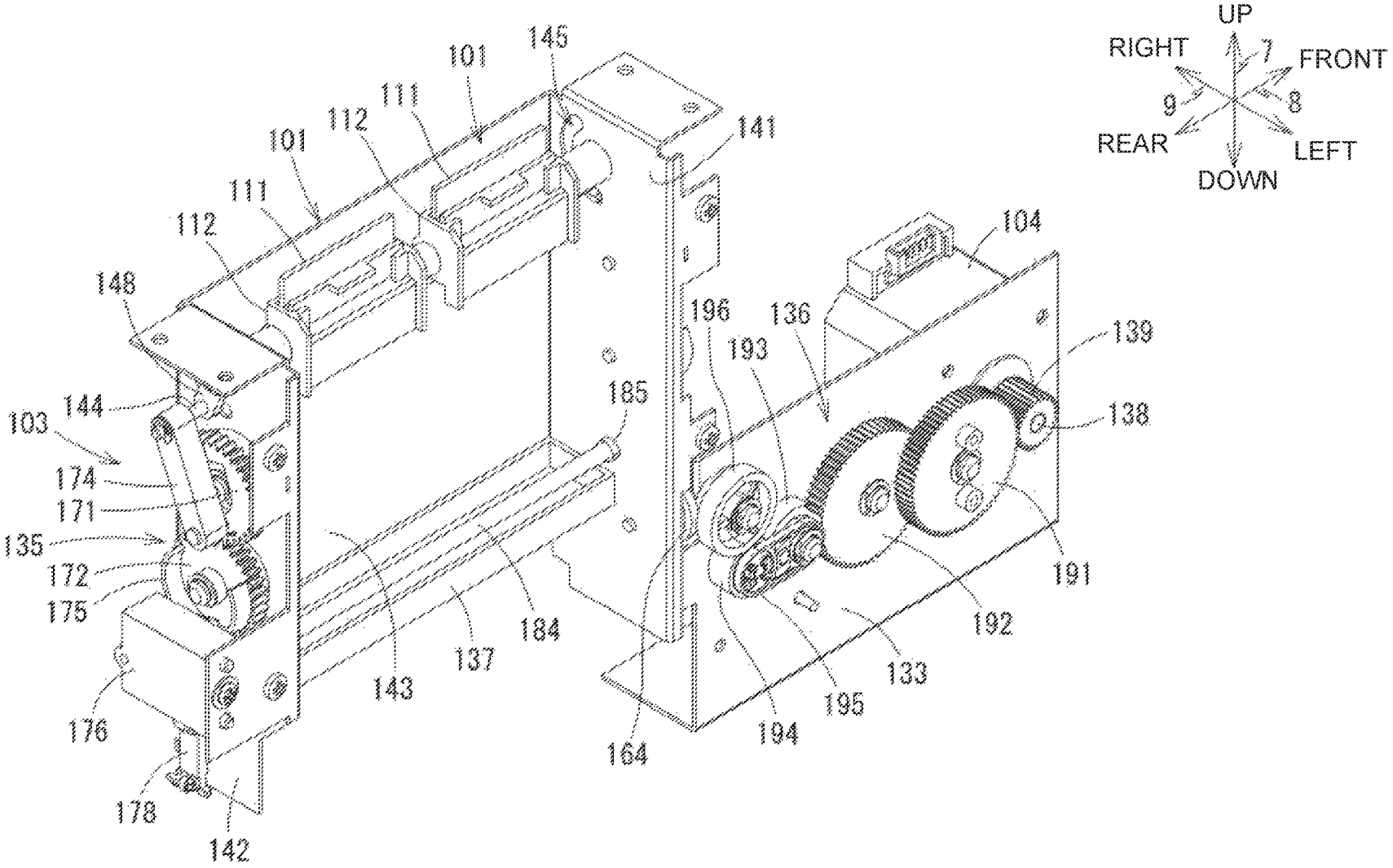
FIG. 10 depicts a perspective view illustrating the appearances of the first frame 131 and the third frame 133.
Figure 11:
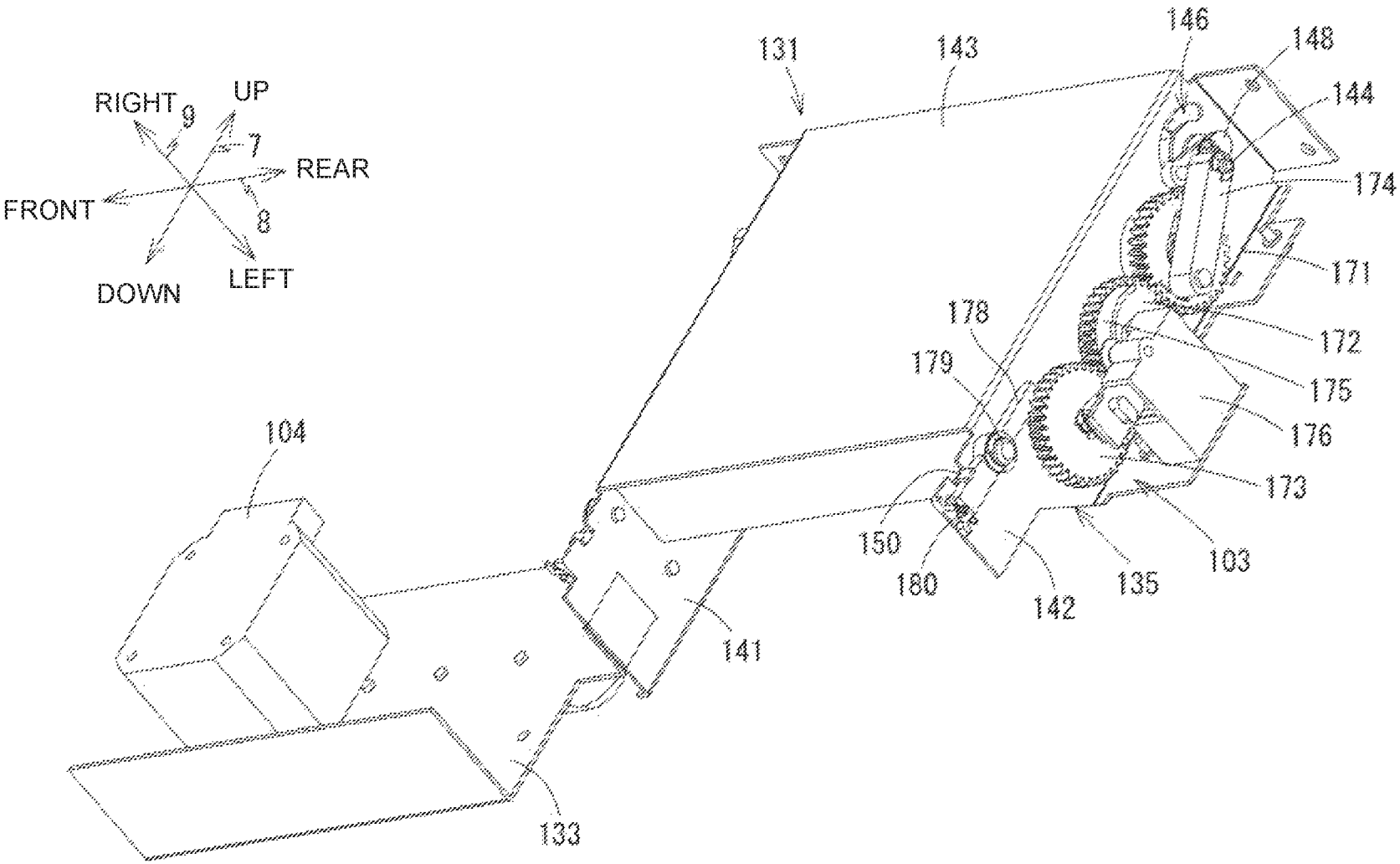
FIG. 11 depicts a perspective view illustrating the appearances of the first frame 131 and the third frame 133.
Figure 13:
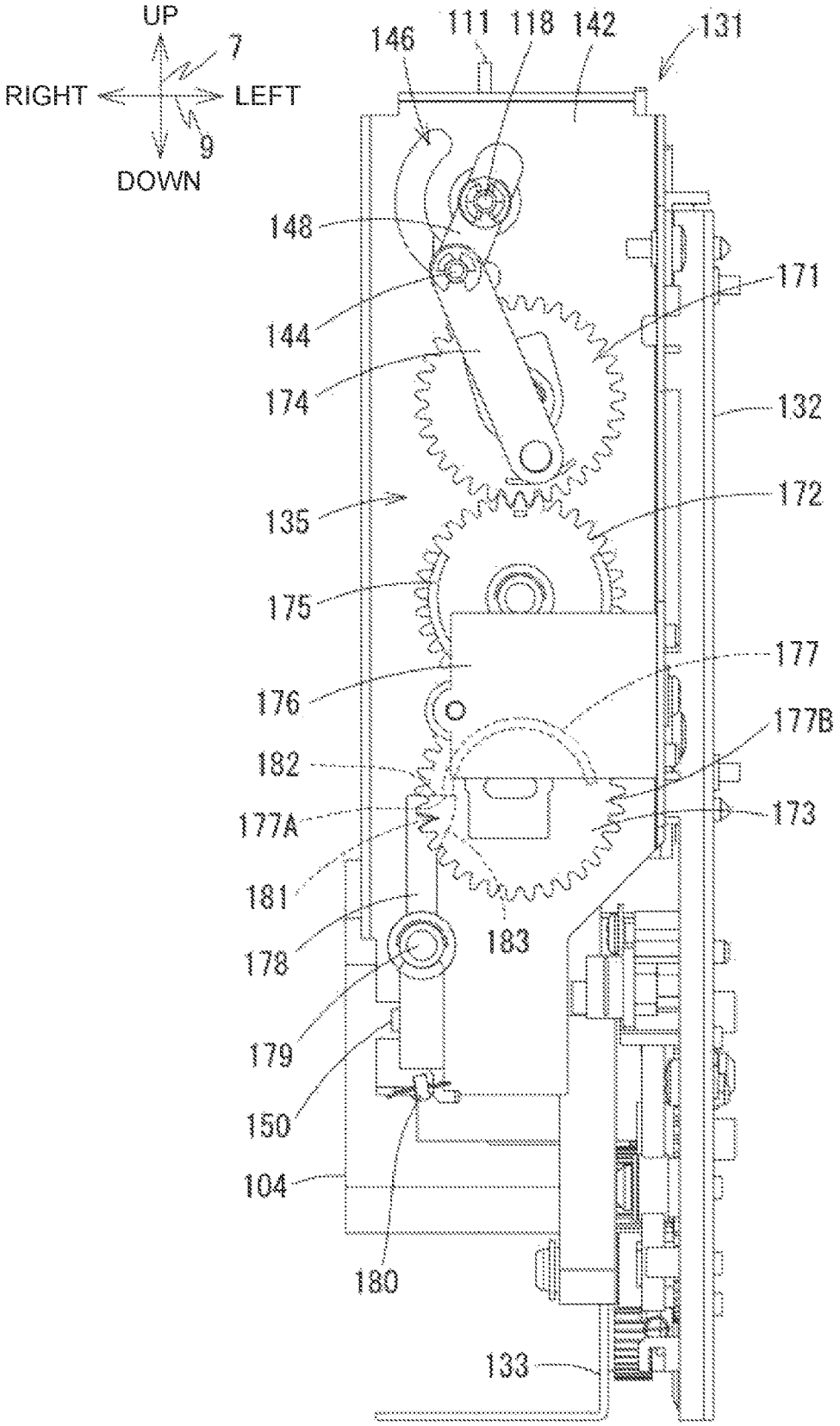
FIG. 13 depicts a back view illustrating rear surfaces of the first frame 131 and the third frame 133.

As depicted in FIGS. 10, 11, and 13, the gear train 135 has three gears 171, 172, 173 which are meshed with each other in series. The gear 171 is positioned under or below the shaft 118 and the input shaft 144. The axis of the gear 171 is parallel to the axis of the shaft 118 and the axis of the input shaft 144. A connecting rod 174 connects a portion of the gear 171 separated in the radial direction from the axis and the rear end of the input shaft 144. The connecting rod 174 transmits the rotation of the gear 171 as the reciprocating motion about the shaft 118 of the input shaft 144. The gear 171 and the connecting rod 174 are an example of the crank.

The gear 172 is positioned under or below the gear 171, and the gear 172 is meshed with the gear 171. The axis of the gear 172 is parallel to the axis of the shaft 118 and the axis of the input shaft 144. The gear 172 has a detection target wall 175 which protrudes frontwardly from the gear 172 in the circumferential direction of the gear 172, i.e., in the orientation to make separation from the front wall 141. The detection target wall 175 exists at only a part of the gear 172 in the circumferential direction, and the detection target wall 175 does not exist over the entire circumference. When the detection target wall 175 is detected by an optical sensor 176, the rotation position of the gear 172 is judged thereby.

The gear 173 is positioned under or below the gear 172, and the gear 173 is meshed with the gear 172. The axis of the gear 173 is parallel to the axis of the shaft 118 and the axis of the input shaft 144. As depicted by broken lines in FIG. 13, the gear 173 has a lock wall 177 which protrudes frontwardly from the gear 173 in the circumferential direction of the gear 173, i.e., toward the rear wall 142. The lock wall 177 exists at only a part of the gear 172 in the circumferential direction, and the lock wall 177 does not exist over the entire circumference. When a stopper 178 is engaged with the lock wall 177, the rotation of the gear 173 in one direction (counterclockwise rotation as viewed in FIG. 13) is regulated thereby. When the blade 111 is in the second posture, the stopper 178 is engaged with the lock wall 177.

As depicted in FIGS. 11 and 13, the stopper 178 is supported by the rear wall 142. The stopper 178 is rotatable about a shaft 179 which is disposed in parallel to the axis of the gear 173. An extension spring 180 is positioned between the lower end of the stopper 178 and the rear wall 142. The extension spring 180 urges the stopper 178 clockwise as viewed in FIG. 13. An abutment wall 150 is formed on the rear wall 142. The abutment wall 150 abuts against the lower end side of the stopper 178 to regulate the counterclockwise rotation of the stopper 178. The stopper 178 is rotatable counterclockwise as viewed in FIG. 13 against the urging force of the extension spring 180 as starting from the state in which the stopper 178 abuts against the abutment wall 150.

As depicted by broken lines in FIG. 13, a hook-shaped fastening section 181 is formed at the upper end of the stopper 178. The fastening section 181 has a lock surface 182 and a sliding surface 183. The lock surface 182 abuts against one end surface 177A in the circumferential direction of the lock wall 177, while being approximately orthogonal thereto. When the lock surface 182 abuts against the one end surface 177A in the circumferential direction of the lock wall 177, the rotation in one direction of the gear 173 is regulated thereby. The sliding surface 183 abuts against the other end surface 177B in the circumferential direction of the lock wall 177, while being not orthogonal thereto. When the gear 173 is rotated in the other direction (clockwise as viewed in FIG. 13) as starting from the state in which the sliding surface 183 abuts against the other end surface 177B of the lock wall 177, then the other end surface 177B of the lock wall 177 slides on the sliding surface 183, and the stopper 178 is rotated counterclockwise as viewed in FIG. 13 against the urging force of the extension spring 180.

As depicted in FIGS. 8 and 10, the gear 153 and the gear 173 are supported by the shaft 184. The shaft 184 are rotatably supported by the front wall 141 and the rear wall 142 by the aid of bearings 185, 186 provided for the front wall 141 and the rear wall 142 respectively. The shaft 184 is positioned under or below the blade holders 112 between the front wall 141 and the rear wall 142 in the front-rear direction 8. Further, the shaft 184 is positioned over or above the receiving pan 137.

As depicted in FIGS. 8 and 10, the third frame 133 supports the motor 104 and the gear train 136. The motor 104 has an output shaft 138. A gear 139 is fixed to the output shaft 138. When the motor 104 is driven, the gear 139 is rotated together with the output shaft 138. The output shaft 138 extends in the left-right direction 9.

The gear train 136 has a reduction gear 191, a gear 192, a sun gear 193, a planet gear 194, and a bevel gear 196. The reduction gear 191, the gear 192, the sun gear 193, and the bevel gear 196 are rotatably supported by the third frame 133. Respective axes of all of the reduction gear 191, the gear 192, the sun gear 193, the planet gear 194, and the bevel gear 196 extend in the left-right direction 9.

The reduction gear 191 is meshed with the gear 139 and the gear 192. The reduction gear 191 transmits the rotation of the gear 139 to the gear 192 at a predetermined reduction ratio. The sun gear 193 is meshed with the gear 192. The planet gear 194 is rotatably supported by a support arm 195 which is rotatably connected to the shaft of the sun gear 193, and the planet gear 194 is meshed with the sun gear 193. The planet gear 194 is rotatable to the position at which the planet gear 194 is meshed with the bevel gear 196 and the position at which the planet gear 194 is not meshed with the bevel gear 196, depending on the rotation direction of the sun gear 193. The position, at which the planet gear 194 is meshed with the bevel gear 196, is an example of the first position. The position, at which the planet gear 194 is not meshed with the bevel gear 196, is an example of the second position.

The bevel gear 196 is meshed with the bevel gear 164. The rotation is transmitted from the gear train 136 to the gear train 134 owing to the bevel gear 196 and the bevel gear 164 which are meshed with each other. The rotation of the gear 153 meshed with the bevel gear 164 is transmitted to the gear 173 via the shaft 184. Accordingly, the gear train 134 and the gear train 135 are rotated synchronously.

Figure 14:
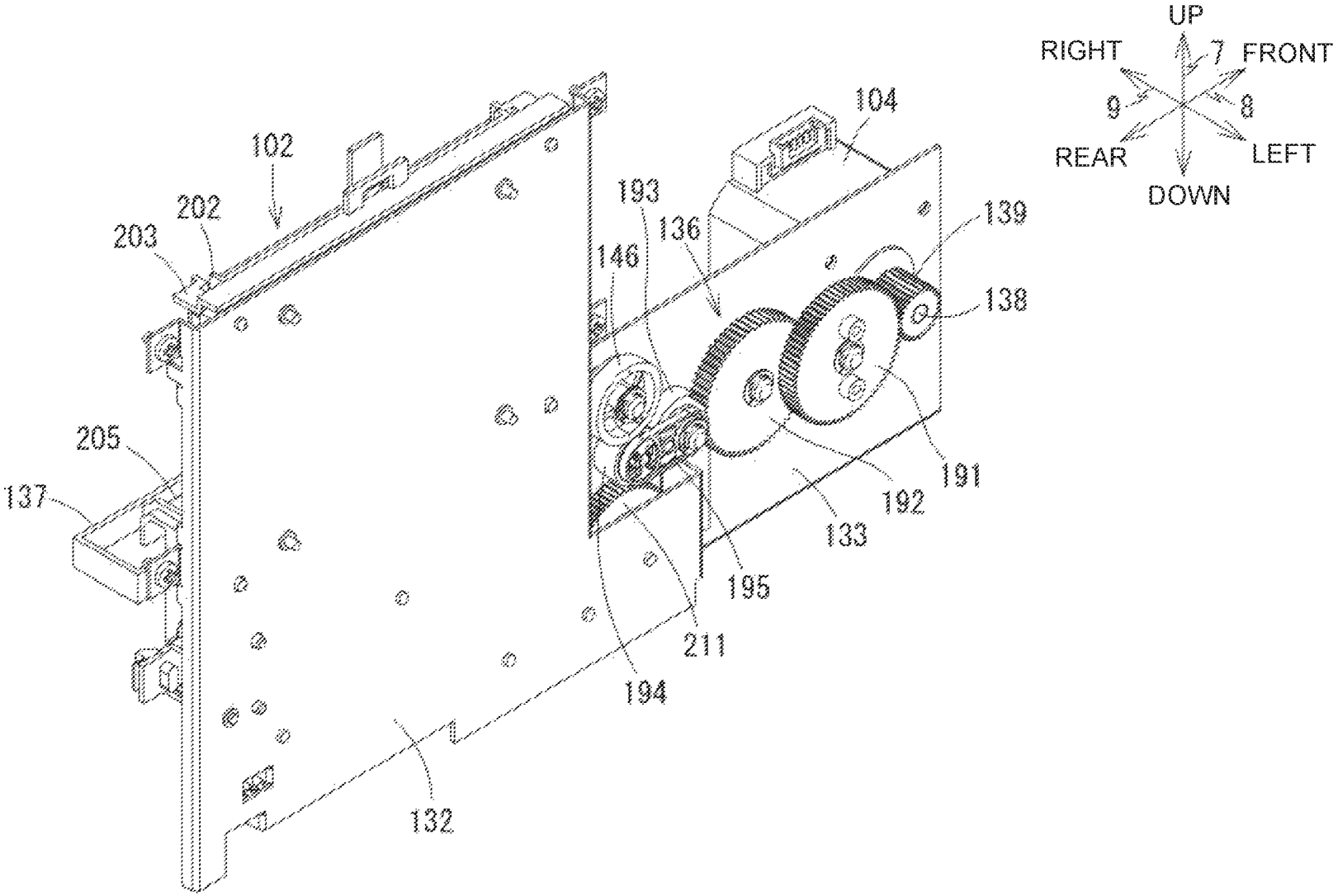
FIG. 14 depicts a perspective view illustrating appearances of a second frame 132 and the third frame 133.
Figure 15:
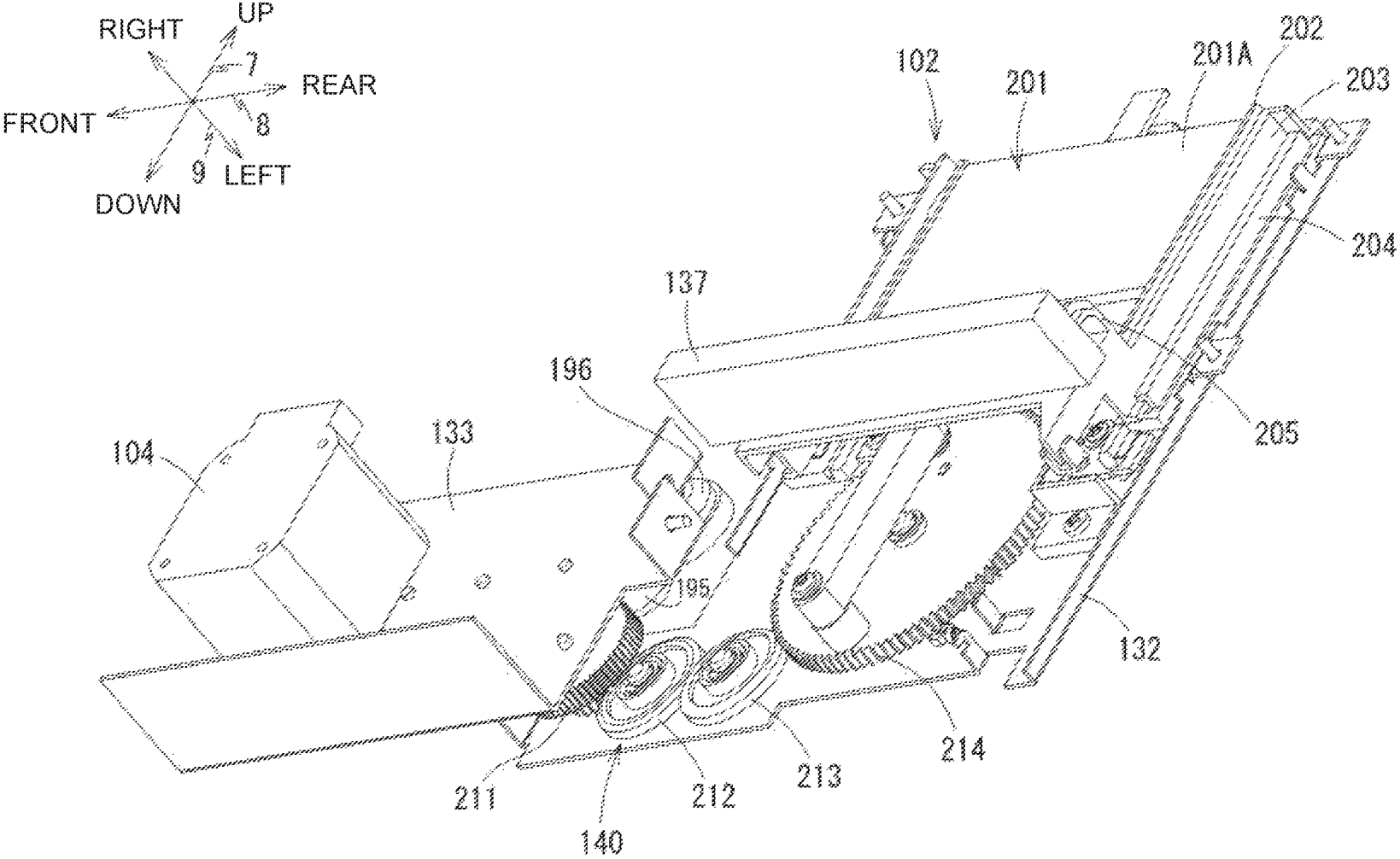
FIG. 15 depicts a perspective view illustrating the appearances of the second frame 132 and the third frame 133.

As depicted in FIGS. 14 and 15, the second frame 132 supports the cleaner 102 and a gear train 140 (example of the cleaner moving mechanism). The cleaner 102 wipes out the ink adhered to the blades 111. As depicted in FIGS. 2 and 3, the cleaner 102 is positioned between the cap 73 and the blades 111 in the left-right direction 9.

As depicted in FIGS. 14 and 15, the cleaner 102 has a foam 201, a plate 202, and a cleaner holder 203. The foam 201 is the member which can be impregnated with a cleaning liquid and which can retain the same. For example, the foam 102 is a resin having minute pores formed by foaming. The plate 202 supports the foam 201. The foam 201 has a flat plate-shaped form, wherein the maximum surface, which is exposed on the side opposite to the plate 202, is a cleaning surface 201A. The cleaning surface 201A expands in the up-down direction 7 and the front-rear direction 8. That is, the cleaning surface 201A intersects the nozzle surface 243 of the printing head 24.

As depicted in FIG. 15, the gear train 140 has a reduction gear 211, and three gears 212, 213, 214 which are meshed with each other in series. All of the respective axes of the reduction gear 211 and the three gears 212, 213, 214 which are meshed with each other in series extend in the left-right direction 9. The reduction gear 211 is meshed with the planet gear 194 disposed at the second position. Further, the reduction gear 211 is meshed with the gear 212. The reduction gear 211 transmits the rotation of the planet gear 194 to the gear 212 at a predetermined reduction ratio. The rotation is transmitted to the gear 214 via the gears 212, 213.

A connecting rod 215 connects a portion of the gear 214 separated in the radial direction from the axis and a lower end portion of the cleaner holder 203. The connecting rod 215 transmits the rotation of the gear 214 as the reciprocating motion in the up-down direction 7 of the cleaner holder 203. The gear 214 and the connecting rod 215 forms a crank.

The cleaner holder 203 supports the plate 202 in a state in which the cleaning surface 201A of the foam 201 is directed rightwardly, i.e., in the orientation opposite to the second frame 132. The second frame 132 supports guide members 204 which are positioned on the both sides in the front-rear direction 8 of the cleaner holder 203. The guide members 204 are the members which extend in the up-down direction 7. The guide members 204 are mutually fitted to the both ends in the front-rear direction 8 of the cleaner holder 203 to slidably support the cleaner holder 203 in the up-down direction 7. In accordance with the sliding movement of the cleaner holder 203, the foam 201 is moved to a third position (position indicated by solid lines in FIG. 17) which is disposed under or below the blades 111 in the second posture and a fourth position (position indicated by broken lines in FIG. 17) which is disposed over or above the blades 111 in the second posture. When the foam 201 is disposed at the third position, the cleaner 102 is positioned under or below the nozzle surface 243 of the printing head 24. In other words, when the foam 201 is disposed at the third position, the cleaner 102 is not overlapped with the printing head 24 in the up-down direction 7.

The cleaner holder 203 has a brim section 205. The brim section 205 protrudes rightwardly from the foam 201 from a lower portion of the plate 202. The protruding end of the brim section 205 hangs downwardly. The brim section 205 is positioned over or above the shaft 184 (see FIG. 8) and the receiving pan 137. The brim section 205 covers almost all of the shaft 184 between the front wall 141 of the first frame 131 and the rear wall 142. The protruding end of the brim section 205 is positioned rightwardly from the shaft 184 over or above the receiving pan 137.

[Wiping Action]

An explanation will be made below with reference to FIG. 16 about the wiping action (example of the first sliding action). The blades 111 are in the second posture before the wiping action, for example, when the image recording is executed. The blade 111 in the second posture does not make contact with the nozzle surface 243 of the printing head 24 which is movable in the left-right direction 9. Further, the foam 201 of the cleaner 102 is disposed at the third position. The foam 201, which is disposed at the third position, does not make contact with the printing head 24 which is movable in the left-right direction 9.

When the motor 104 is driven in the wiping action, the rotation of the motor 104 (assumed to be the forward rotation in this embodiment) is transmitted to the gear trains 134, 135 via the gear train 136. When the motor 104 performs the forward rotation, the planet gear 194 is meshed with the bevel gear 196.

In accordance with the forward rotation of the motor 104, the gear trains 134, 135 rotate the blades 111 about the shaft 118 by the aid of the input shaft 144. If the optical sensor 176 detects the detection target wall 175, it is thereby judged whether or not the gear 172 arrives at the rotation position at which the blades 111 are in the first posture or whether or not the gear 172 arrives at the rotation position at which the blades 111 are in the second posture.

Figure 16:
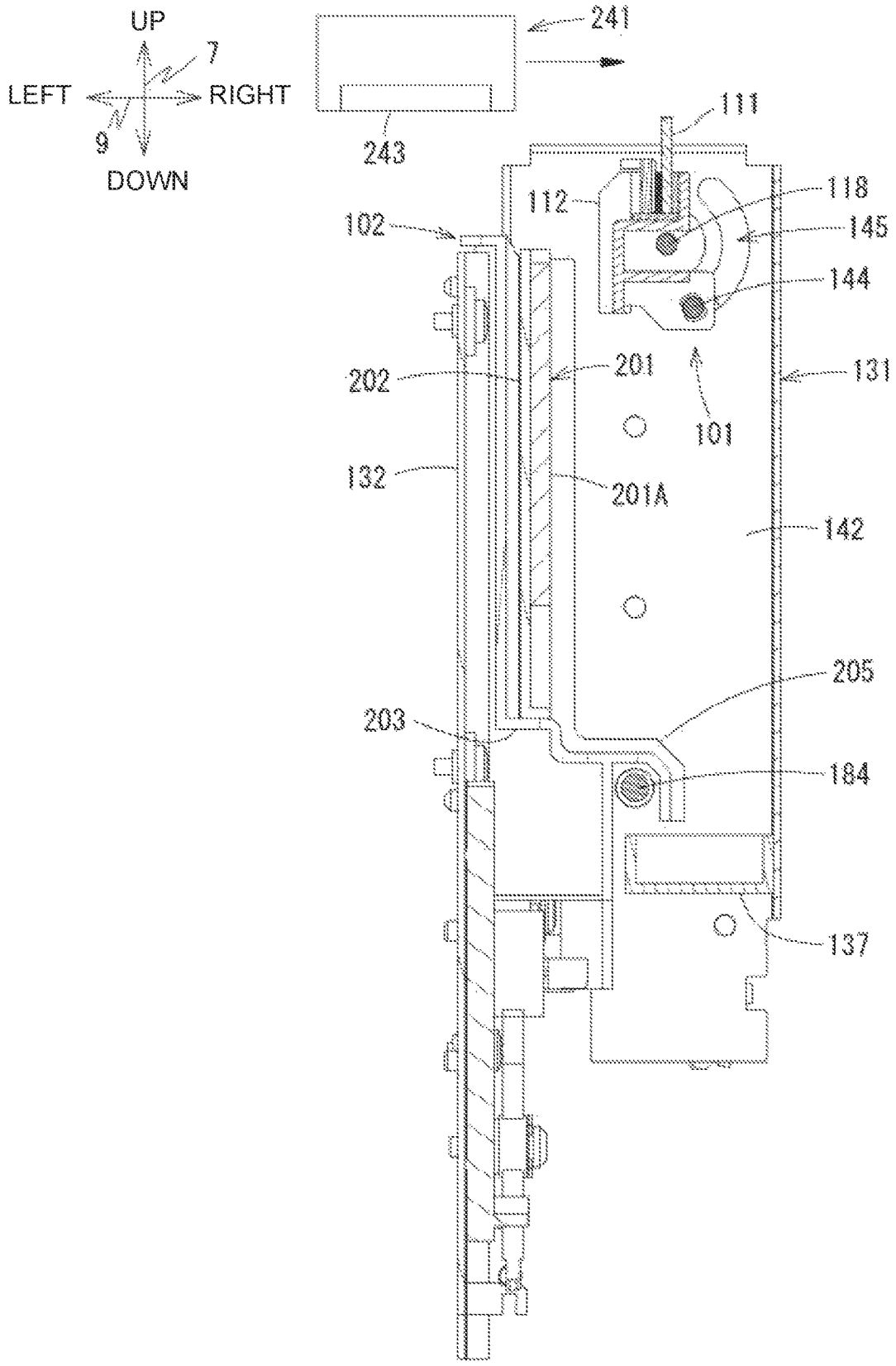
FIG. 16 depicts a sectional view taken in the up-down direction 7 and the left-right direction 9 of the maintenance unit 100 in order to explain the wiping action.

As depicted in FIG. 16, when the gear 172 arrives at the rotation position at which the blades 111 are in the first posture, the rotation of the motor 104 is stopped. The motor 104, the rotation of which is stopped, is maintained in a magnetically excited state. The motor 104 is magnetically excited, and the planet gear 194 is meshed with the bevel gear 196. Therefore, even when the nozzle surface 243 is brought in contact with the blades 111, the blades 111 are retained in the first posture.

When the carriage 241, which is positioned over or above the cap 73, is moved rightwardly in the left-right direction 9 in the state in which the blades 111 are retained in the first posture, the nozzle surface 243 of the printing head 24 is moved while making abutment against the forward ends of the blades 111. That is, the nozzle surface 243 and the blades 111 are relatively moved while making contact with each other. Accordingly, the ink, which adheres to the nozzle surface 243, is wiped out by the blades 111. Further, the foam 201 is disposed at the third position, and hence the cleaner 102 is not brought in contact with the nozzle surface 243.

[Cleaning Action]

Figure 17:
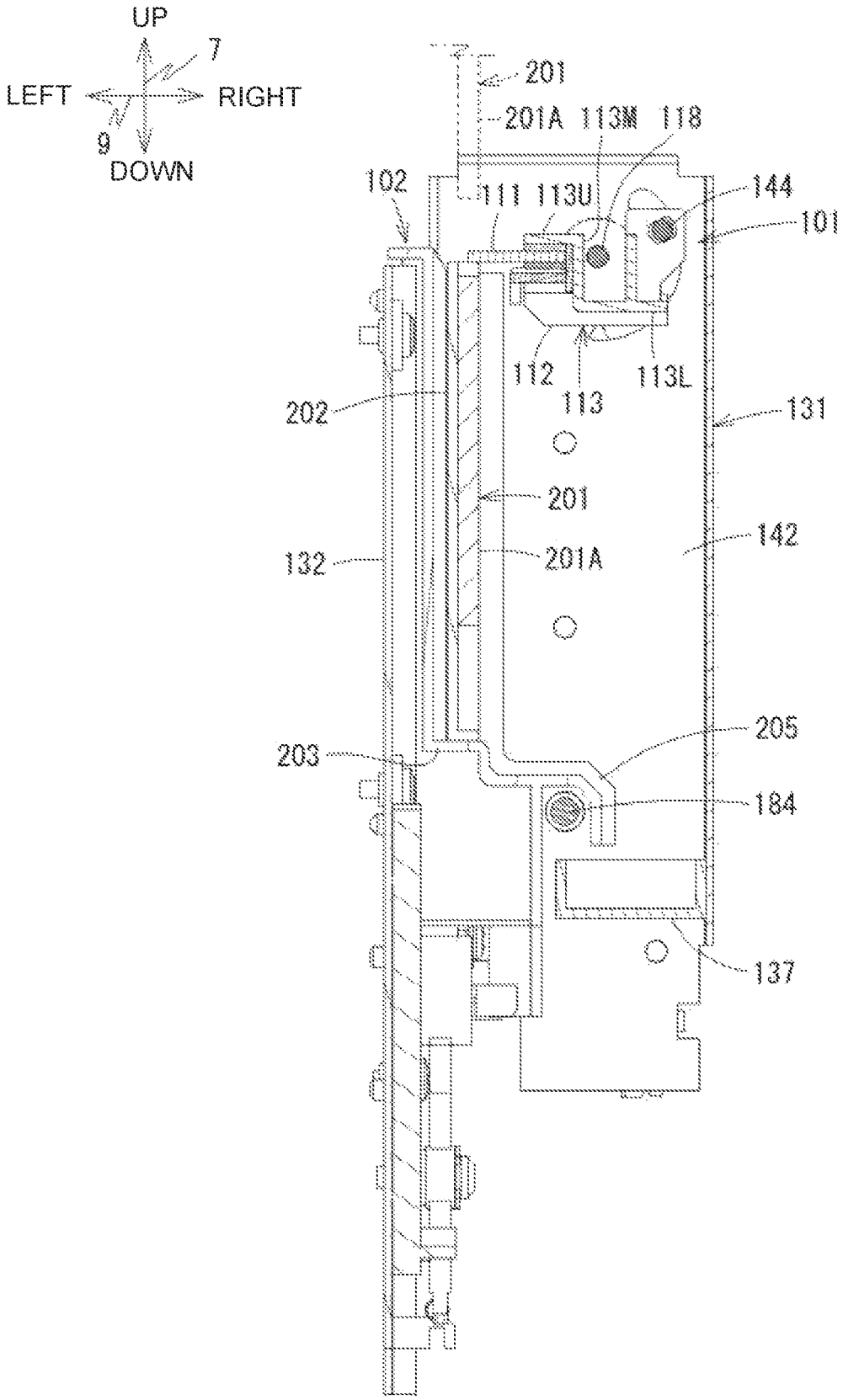
FIG. 17 depicts a sectional view taken in the up-down direction 7 and the left-right direction 9 of the maintenance unit 100 in order to explain the cleaning action.

An explanation will be made below with reference to FIG. 17 about the cleaning action (example of the second sliding action). The foam 201 of the cleaner 102 is disposed at the third position (waiting position) before the cleaning action is started. Further, the carriage 241 is positioned over or above the cap 73 or over or above the platen 25, while the carriage 241 is not positioned over or above the blades 111 or over or above the cleaner 102. In the cleaning action, when the motor 104 is subjected to the forward rotation in the same manner as in the wiping action, the blades 111 are rotated about the shaft 118. When the gear 172 arrives at the rotation position at which the blades 111 are in the second posture as depicted in FIG. 17, the rotation of the motor 104 is stopped. The foam 201, which is disposed at the third position, is positioned under or below the blades 111 which are in the second posture.

When the blades 111 are in the second posture, the shaft 118 is positioned over or above the lowermost positions of the lower portions 113L of the partition walls 113 of the blade holders 112. The forward end portion of the blade 111 in the second posture (left end portion as viewed in FIG. 17) is disposed closely to the cleaning surface 201A of the foam 201 in the left-right direction 9 as compared with the forward end portion of the blade 111 in the first posture (upper end portion as viewed in FIG. 16).

After the blades 111 are in the second posture, the motor 104 is reversely rotated. In accordance with the reverse rotation of the motor 104, the planet gear 194 is separated from the bevel gear 196, and the planet gear 194 is meshed with the reduction gear 211 of the gear train 140. Accordingly, the reverse rotation of the motor 104 is transmitted to the cleaner holder 203 via the gear train 140. The cleaner holder 203, to which the rotation of the motor 104 is transmitted, is moved from the third position to the fourth position. When the cleaner holder 203 is positioned at the fourth position, the foam 201 is disposed at the position indicated by broken lines in FIG. 17.

When the cleaner holder 203 is moved from the third position to the fourth position, the foam 201 is moved upwardly while allowing the cleaning surface 201A of the foam 201 to abut against the forward end portions of the blades 111. That is, the blades 111 are relatively moved while making contact with the cleaning surface 201A. Accordingly, the ink which adheres to the blades 111, especially the ink which adheres to the lower surfaces of the blades 111 in the second posture is wiped out by the foam 201.

When the foam 201 is moved upwardly while making contact with the blades 111, the force is applied to the blades 111 to cause the movement from the second posture to the first posture. In other words, with reference to FIG. 17, the force, which rotates the blade holders 112 clockwise, is applied to the blade holders 112.

When the blades 111 are in the second posture, the stopper 158 regulates the gear 153 from the clockwise rotation as viewed in FIG. 12. The stopper 178 regulates the gear 173 from the counterclockwise rotation as viewed in FIG. 13. That is, the stoppers 158, 178 regulate the rotation of the gears 153, 178 which would be caused by the movement of the blade holders 112 from the second posture to the first posture. Accordingly, even when the foam 201 is moved upwardly while making contact with the blades 111, the blades 111, which are in the second posture, are not moved to the first posture.

The direction, in which the cleaner 102 is moved in the cleaning action, is directed in the up-down direction 7. On the other hand, the direction, in which the carriage 241 is moved in the wiping action, is directed in the left-right direction 9. In other words, the direction, in which the cleaner 102 is moved in the cleaning action, intersects the direction in which the carriage 241 is moved in the wiping action. Further, when the foam 201 is moved from the third position to the fourth position, the cleaner 102 passes through the position of the nozzle surface 243 in the up-down direction 7.

The cleaning surface 201A of the foam 201 disposed at the fourth position is separated upwardly from the blades 111 which are in the second posture. When the foam 201 is disposed at the fourth position, the motor 104 is subjected to the forward rotation until the blades 111 in the second posture have the first posture. The motor 104 is subjected to the reverse rotation until the foam 201 at the fourth position has the third position after the blades 111 are in the first posture. Then, when the foam 201 arrives at the third position, the motor 104 is subjected to the forward rotation until the blades 111 in the first posture have the second posture. Accordingly, the cleaning action is terminated.

Function and Effect of this Embodiment

According to this embodiment, the direction (left-right direction 9), in which the carriage 241 is moved in the wiping action, intersects the direction (up-down direction 7) in which the cleaner 102 is moved in the cleaning action. Therefore, even when the length, over which the blades 111 and the cleaning surface 201A make the sliding movement while making contact with each other, is prolonged or lengthened, then the external form of the printing apparatus 10 is not large-sized, and the space efficiency is satisfactory at the inside of the apparatus.

Further, the cleaner 102, which is moved from the third position to the fourth position, passes through the position of the nozzle surface 243 in the up-down direction 7. Therefore, even when the length, over which the blades 111 and the cleaning surface 201A make the sliding movement while making contact with each other, is prolonged or lengthened, then the external form of the printing apparatus 10 is not large-sized, and the space efficiency is satisfactory at the inside of the apparatus.

Further, the foam 201 of the cleaner 102 disposed at the third position is positioned under or below the forward end portions of the blades 111 in the second posture, and the foam 201 of the cleaner 102 disposed at the fourth position is positioned over or above the forward end portions of the blades 111 in the second posture. Therefore, the blades 111 can be brought in contact with the cleaning surface 201A which is moved from the downward to the upward.

Further, the cleaning surface 201A of the cleaner 102 disposed at the fourth position is separated from the blades 111 in the second posture. Therefore, when the cleaner 102 is disposed at the fourth position, it is easy to rotate the blades 111.

Modified Embodiments

In the embodiment described above, the relative movement between the blades 111 in the first posture and the printing head 24 is realized by the movement of the carriage 241. However, there is no limitation thereto. It is also allowable that the blades 111 are moved with respect to the printing head 24, while the printing head 24 is not moved.

Further, in the embodiment described above, the head of the so-called line head type is adopted, in which the printing head 24 is not moved when the printing apparatus 10 performs the printing on the roll paper 11. However, there is no limitation thereto. For example, a head of the so-called serial head type may be adopted, which repeatedly performs the operation comprising discharging the ink while moving the printing head 24 in the left-right direction 9 with respect to the roll paper 11 allowed to stop when the printing apparatus 10 performs the printing on the roll paper 11, and thereafter conveying the roll paper 11 in order to perform the line feed.

Further, in the embodiment described above, the relative movement between the blades 111 in the second posture and the cleaner 102 is realized by the movement of the cleaner 102. However, there is no limitation thereto. It is also allowable that the blades 111 are moved with respect to the cleaner 102, while the cleaner 102 is not moved.

Further, in the embodiment described above, the cleaner 102 has the foam 201 which can retain the liquid. However, the cleaner 102 is not limited to one having the foam 201. For example, in place of the foam 201, the cleaner 102 may have a hard resin member which has a concave/convex shape on its surface, or a member in which a plurality of wires extending in the front-rear direction 8 are aligned in the up-down direction 7.

Further, in the embodiment described above, the blades 111 are subjected to the posture change to the first posture and the second posture by making the rotation about the shaft 118. However, the postures of the blades 111 may be changed by means of any action other than the rotation. Further, the locus of the forward end of the blade 111 during the posture change is not limited to the circular arc. For example, any component in the up-down direction 7 may be included in the locus of the forward end of the blade 111 in the posture change. That is, the blade 111 may be subjected to the posture change such that the blade 111 is linearly moved in the up-down direction 7, and then the blade 111 is rotated.

Further, the tank 70 is not limited to the tank which stores the ink of one color of black. For example, it is also allowable to use those which store inks of four colors of black, yellow, cyan, and magenta respectively.

Further, the ink is not limited to the liquid which contains, for example, the pigment and the resin fine particles. Therefore, if the ink does not contain the resin fine particles, it is also allowable that the printing apparatus 10 does not have the heater 26. Further, the liquid, which is discharged from the nozzles 30 of the printing head 24, is not limited to the ink. For example, it is also allowable to discharge, from the nozzles 30 of the printing head 24, any arbitrary liquid including, for example, a processing liquid which aggregates or deposits the component contained in the ink, and a liquid in which metal particles are dispersed in a solvent.

Further, it is not necessarily indispensable that the discharge port 13 is formed on the front surface 31 of the casing 14. For example, the discharge port 13 may be formed on the upper wall 33 of the casing 14, and the roll paper 11, which has been subjected to the printing and which passes through the discharge port 13, may be discharged upwardly or obliquely upwardly.

Further, the printing apparatus 10 described above can perform the printing on the roll paper 11. However, there is no limitation thereto. For example, the printing apparatus 10 may be an apparatus which performs the printing on the roll paper 11 and the cut paper, or the printing apparatus 10 may be an apparatus which performs the printing on only the cut paper.

Further, the printing apparatus 10 is not limited to those which perform the printing on the printing paper. For example, the printing apparatus 10 may perform the printing, for example, on a T-shirt or a sheet for outdoor advertisement. Further, the printing apparatus 10 may perform the recording by discharging any liquid other than the ink, for example, any wiring pattern material onto a wiring substrate. Further, the printing apparatus 10 may perform the recording by discharging the ink, for example, with respect to a case of a mobile phone terminal such as a smartphone or the like, a corrugated cardboard, or a resin.

Further, the printing apparatus 10 described above is used in the state in which the front wall 31 and the rear wall 32 of the casing 14 extend in the up-down direction 7 and the left-right direction 9. However, the posture of the use of the printing apparatus 10 is not limited thereto.

What is claimed is:

1. A liquid discharge apparatus comprising:

a head including a nozzle surface in which a plurality of nozzles is opened;

a wiper including a blade and a blade holder supporting the blade;

a posture changer configured to change a posture of the blade between a first posture in which the blade is capable of contacting the nozzle surface of the head and a second posture which is different from the first posture; and a cleaner including a cleaning surface intersecting the nozzle surface, wherein the blade in the first posture is configured to move in a first sliding direction relatively with respect to the head in a state in which the blade contacts the nozzle surface, and wherein in a case that the blade is in the second posture, one of the blade and the cleaner, or both the blade and the cleaner are configured to move relative to each other in a second sliding direction intersecting the first sliding direction while the blade contacts the cleaning surface of the cleaner.

2. The liquid discharge apparatus according to claim 1, wherein the posture changer is configured to change the posture of the blade to the first posture and to the second posture by rotating the blade.

3. The liquid discharge apparatus according to claim 2, wherein in a case that the blade is in the second posture, a direction to connect a forward end portion of the blade and a rotation shaft of the blade is parallel to the nozzle surface.

4. The liquid discharge apparatus according to claim 1, further comprising:

a head moving mechanism configured to move the head to a first position and to a second position in a first direction; and a cleaner moving mechanism configured to move the cleaner to a third position and to a fourth position in a second direction intersecting the first direction, wherein the head moving mechanism moves the head in the first direction such that the head relatively moves in the first sliding direction with respect to the blade in the state in which the blade contacts the nozzle surface, wherein the cleaner moving mechanism moves the cleaner in the second direction such that the cleaner relatively moves in the second sliding direction with respect to the blade in the state in which the blade contacts the cleaning surface, wherein the cleaner positioned at the third position is not overlapped with the head in the second direction, and wherein the cleaner passes through a position of the nozzle surface in the second direction in a case that the cleaner is moved from the third position to the fourth position by the cleaner moving mechanism.

5. The liquid discharge apparatus according to claim 4, further comprising:

a cap configured to cover the nozzles, and disposed at a position opposed to the nozzle surface of the head positioned at the first position, wherein the cleaner is disposed between the cap and the wiper in the first direction, wherein a rotation shaft of the blade is orthogonal to both the first direction and the second direction, and wherein a forward end portion of the blade in the second posture is disposed nearer the cleaning surface in the first direction than the forward end portion of the blade in the first posture.

6. The liquid discharge apparatus according to claim 4, wherein the cleaner at the third position is positioned below the forward end portion of the blade in the second posture, wherein the cleaner positioned at the fourth position is positioned above the forward end portion of the blade in the second posture, and wherein the cleaner moving mechanism is configured to reciprocate the cleaner between the third position and the fourth position, the third position being designated as a waiting position.

7. The liquid discharge apparatus according to claim 6, wherein the cleaning surface of the cleaner positioned at the fourth position is separated from the blade in the second posture.

8. The liquid discharge apparatus according to claim 4, wherein a length of the cleaner in the first direction is shorter than a length in the second direction.

9. The liquid discharge apparatus according to claim 1, wherein the cleaning surface is an outer surface of a foam having an impregnating ability of the liquid.

10. The liquid discharge apparatus according to claim 1, wherein the posture changer is configured to rotate the blade holder such that the blade and the blade holder rotate as a unit.

11. A wiping apparatus attachable to a liquid discharge apparatus including a head including a nozzle surface in which nozzles are opened, the wiping apparatus comprising:

a wiper including a blade and a blade holder supporting the blade;

a posture changer configured to change a posture of the blade between a first posture and a second posture which is different from the first posture; and a cleaner including a cleaning surface, wherein the blade in the first posture is configured to move in a first sliding direction relatively with respect to the head in a state in which the blade is capable of contacting the nozzle surface, and wherein the blade in the second posture is configured to move in a second sliding direction intersecting the first sliding direction relatively with respect to the cleaner in a state in which the blade contacts the cleaning surface.

* * * * *